US006055676A

United States Patent [19]

Bainbridge et al.

[11] Patent Number: 6,055,676

[45] Date of Patent: May 2, 2000

[54] PROTECTIVE PADDING FOR SPORTS GEAR

[75] Inventors: David W. Bainbridge, Golden; L. Paul Nickerson, Superior; Grant C. Denton, Boulder, all of Colo.

[73] Assignee: Brock USA, LLC, Boulder, Colo.

[21] Appl. No.: 09/249,452

[22] Filed: Feb. 12, 1999

Related U.S. Application Data

[63] Continuation-in-part of application No. 09/226,311, Jan. 7, 1999, which is a continuation-in-part of application No. 09/158,088, Sep. 22, 1998.

[51] Int. Cl.[7] ..... A41D 13/00

[52] U.S. Cl. ..... 2/456; 2/455; 2/267; 2/16; 2/24; 5/655.4; 5/911

[58] Field of Search ..... 2/456, 455, 463, 2/69, 16, 24, 462, 464, 465, 467, 410, 411, 414, 68, 20, 22, 2.5, 102, 70, 92, 161.1, 909, 910, 911, 227, 267, 268, DIG. 1, DIG. 3; 5/655.4, 911, 953, 702; 128/878, 881, 882; 602/23, 25, 27, 62, 63, 65

[56] References Cited

U.S. PATENT DOCUMENTS

| | | |
|---|---|---|
| 1,652,776 | 12/1927 | Galanis . |
| 2,179,631 | 11/1939 | Holder . |
| 2,298,218 | 10/1942 | Madson . |
| 3,304,219 | 2/1967 | Nickerson . |
| 3,459,179 | 8/1969 | Olesen . |
| 3,477,562 | 11/1969 | Allen et al. . |
| 3,503,841 | 3/1970 | Sterrett . |
| 3,529,306 | 9/1970 | Thorne . |
| 3,552,044 | 1/1971 | Wiele . |
| 3,563,837 | 2/1971 | Smith et al. . |
| 3,606,726 | 9/1971 | Spertus et al. . |
| 3,608,961 | 9/1971 | Heck . |
| 3,629,882 | 12/1971 | Thorne . |
| 3,663,344 | 5/1972 | Brock et al. . |
| 3,755,063 | 8/1973 | Massev et al. . |
| 3,762,404 | 10/1973 | Sakita . |
| 3,816,234 | 6/1974 | Winfield . |
| 3,889,444 | 6/1975 | Davis et al. . |
| 3,968,530 | 7/1976 | Dyson . |
| 3,968,620 | 7/1976 | Keltner . |
| 4,011,611 | 3/1977 | Lederman . |
| 4,054,204 | 10/1977 | Keeton . |
| 4,102,109 | 7/1978 | Modra et al. . |
| 4,121,399 | 10/1978 | Verville . |
| 4,139,920 | 2/1979 | Evans . |
| 4,171,549 | 10/1979 | Morrell et al. . |
| 4,193,499 | 3/1980 | Lookholder . |
| 4,343,047 | 8/1982 | Lazowski et al. . |
| 4,370,754 | 2/1983 | Donzis . |
| 4,391,561 | 7/1983 | Smith et al. . |
| 4,432,110 | 2/1984 | Sutton . |
| 4,472,472 | 9/1984 | Schultz . |
| 4,475,248 | 10/1984 | L'Abbe et al. . |
| 4,577,358 | 3/1986 | Glass . |
| 4,606,087 | 8/1986 | Alivizatos . |
| 4,607,403 | 8/1986 | Alivizatos . |
| 4,620,633 | 11/1986 | Lookholder . |

(List continued on next page.)

FOREIGN PATENT DOCUMENTS

| | | |
|---|---|---|
| 577 328 | 7/1976 | Switzerland . |
| 1 378 494 | 12/1974 | United Kingdom . |

*Primary Examiner*—John J. Calvert
*Assistant Examiner*—Tejash Patel
*Attorney, Agent, or Firm*—W. Scott Carson

[57] ABSTRACT

Protective padding primarily intended for use in sports gear. The outer casing is made of an elastic material that is overfilled to its elastic limit to act in the manner of the preferred embodiments. In a second set of preferred embodiments, the outer casing of the pads are actually filled no more than a simple gravity fill (i.e., 100%) and preferably are under filled (e.g., 90%) to less than a gravity fill. This second set of pads is preferably used in combination with a hard, outer shell. Variations of the basic feature of the first and second sets of pads are also disclosed. The pads of the present invention are lightweight and washable and can be adapted and integrated into a wide variety of items.

13 Claims, 25 Drawing Sheets

U.S. PATENT DOCUMENTS

| | | | |
|---|---|---|---|
| 4,640,080 | 2/1987 | Wright . | |
| 4,642,814 | 2/1987 | Godfrey . | |
| 4,657,003 | 4/1987 | Wirtz . | |
| 4,756,026 | 7/1988 | Pierce | 2/16 |
| 4,905,320 | 3/1990 | Squyers, Jr. . | |
| 5,052,874 | 10/1991 | Johanson . | |
| 5,079,787 | 1/1992 | Pollmann . | |
| 5,103,517 | 4/1992 | Krouskop . | |
| 5,134,725 | 8/1992 | Yeshurun et al. . | |
| 5,134,726 | 8/1992 | Ross . | |
| 5,152,019 | 10/1992 | Hirata . | |
| 5,201,780 | 4/1993 | Dinsmoor, III et al. . | |
| 5,279,237 | 1/1994 | Alivizatos . | |
| 5,301,370 | 4/1994 | Henson | 2/22 |
| 5,351,830 | 10/1994 | Bender et al. . | |
| 5,369,829 | 12/1994 | Jay . | |
| 5,397,620 | 3/1995 | Hord, III . | |
| 5,464,443 | 11/1995 | Wilson et al. . | |
| 5,515,975 | 5/1996 | Jarvis et al. . | |
| 5,537,688 | 7/1996 | Reynolds et al. . | |
| 5,545,128 | 8/1996 | Hayes et al. . | |
| 5,584,072 | 12/1996 | Kim et al. . | |
| 5,622,030 | 4/1997 | Steed et al. . | |
| 5,626,657 | 5/1997 | Pearce . | |
| 5,669,079 | 9/1997 | Morgan . | |
| 5,675,844 | 10/1997 | Guyton et al. . | |
| 5,694,747 | 12/1997 | Tesch . | |
| 5,699,561 | 12/1997 | Broersma . | |
| 5,711,029 | 1/1998 | Visco et al. . | |
| 5,711,215 | 1/1998 | Sextl et al. . | |
| 5,712,015 | 1/1998 | Guillem . | |
| 5,733,012 | 3/1998 | Jones . | |
| 5,778,470 | 7/1998 | Haider . | |
| 5,826,273 | 10/1998 | Eckes . | |
| 5,920,915 | 7/1999 | Bainbridge et al. | 2/456 |

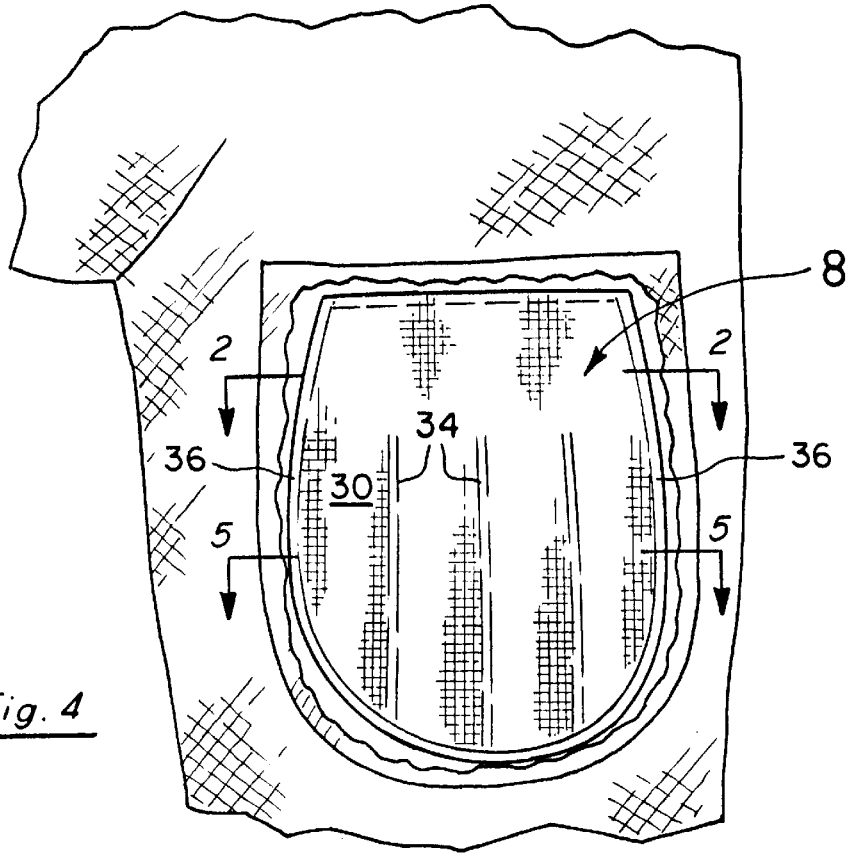
Fig. 4
Fig. 5
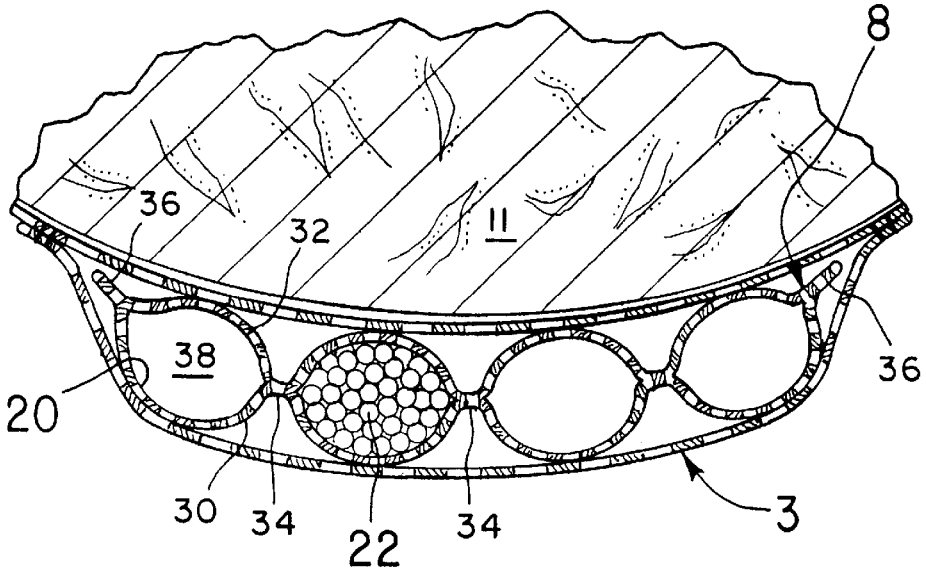

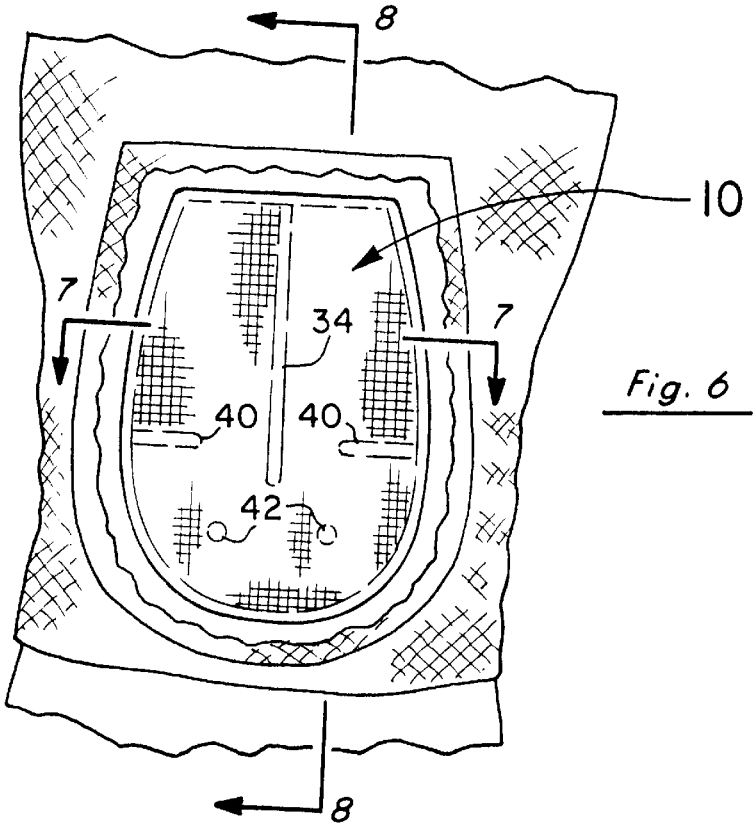
Fig. 6
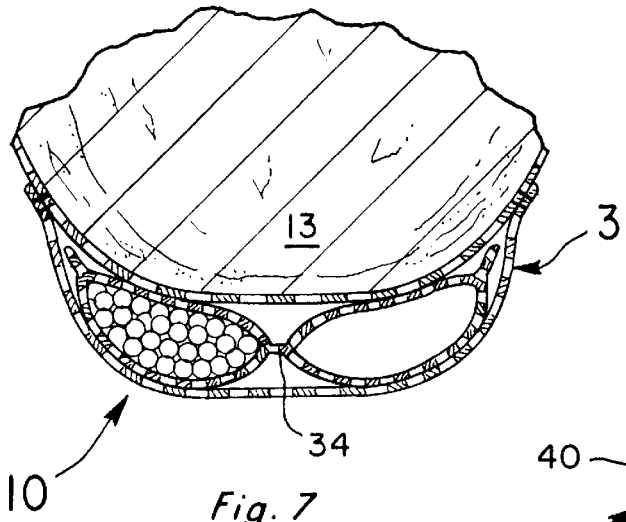
Fig. 7
Fig. 8
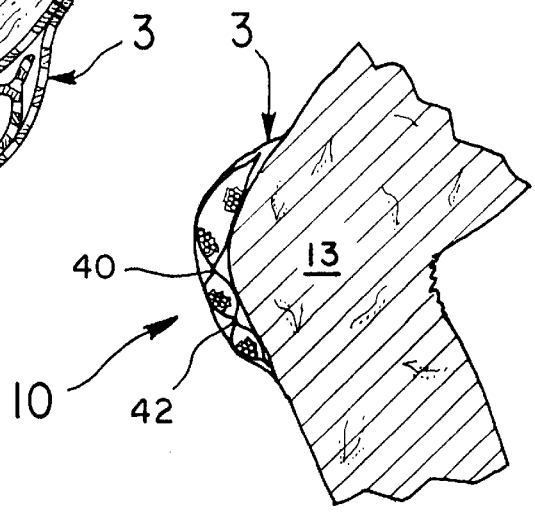

Fig. 10
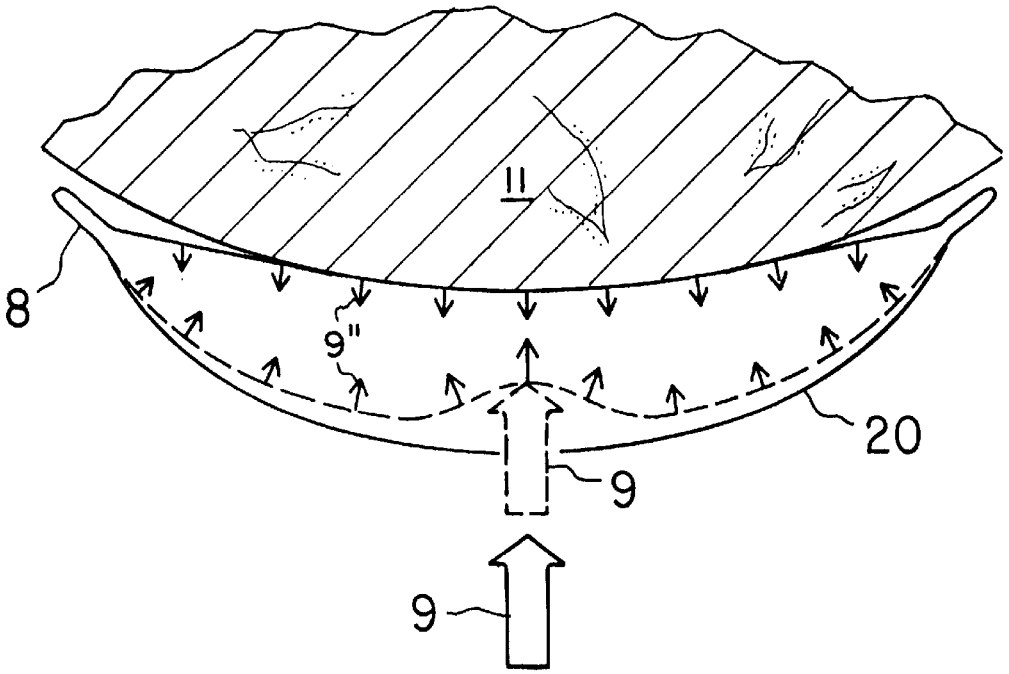
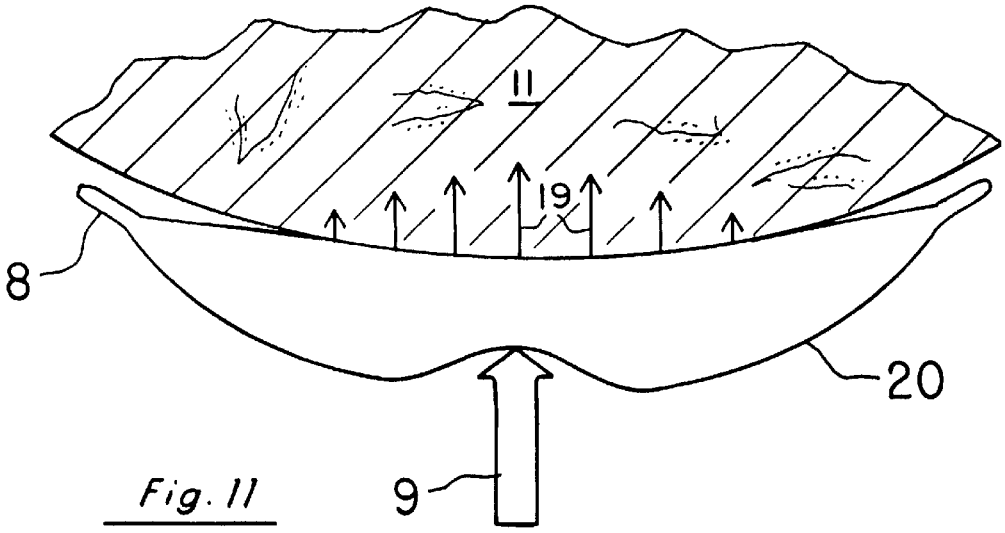
Fig. 11

Fig. 16
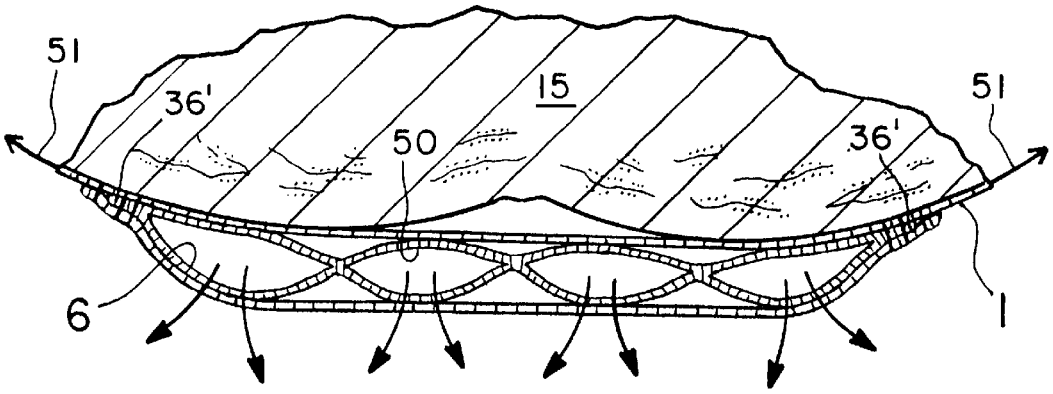
Fig. 17
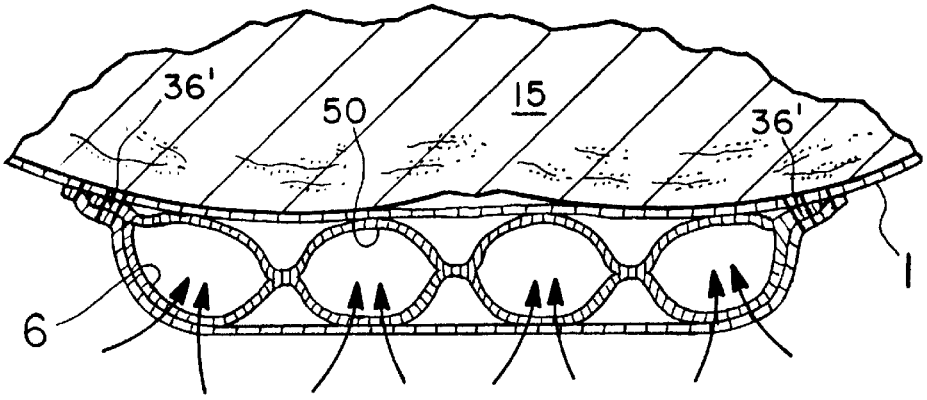
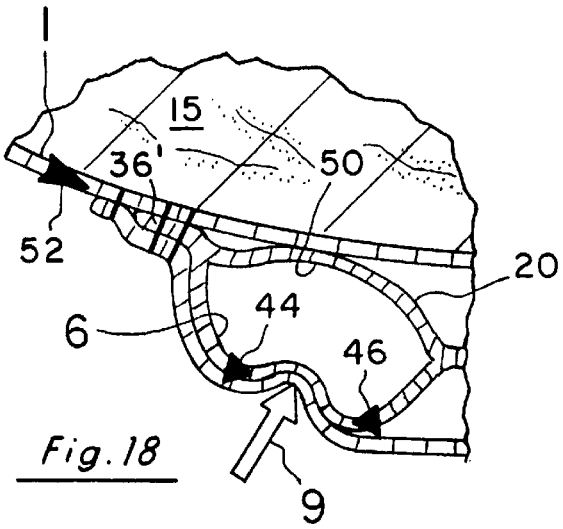
Fig. 18
Fig. 19
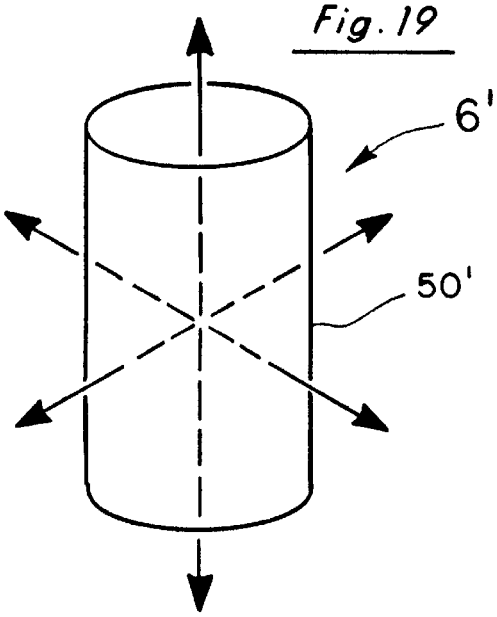

Fig. 20
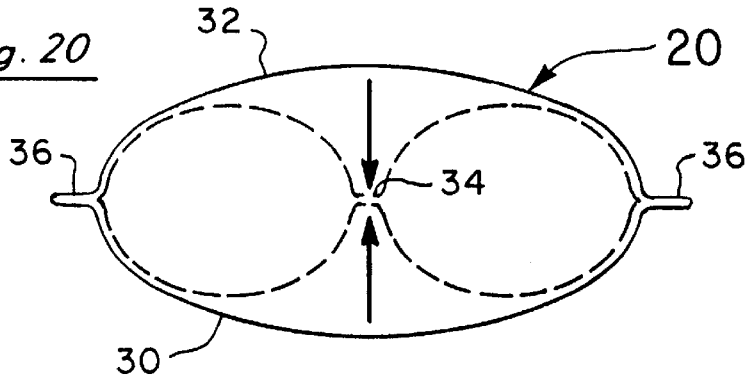
Fig. 21
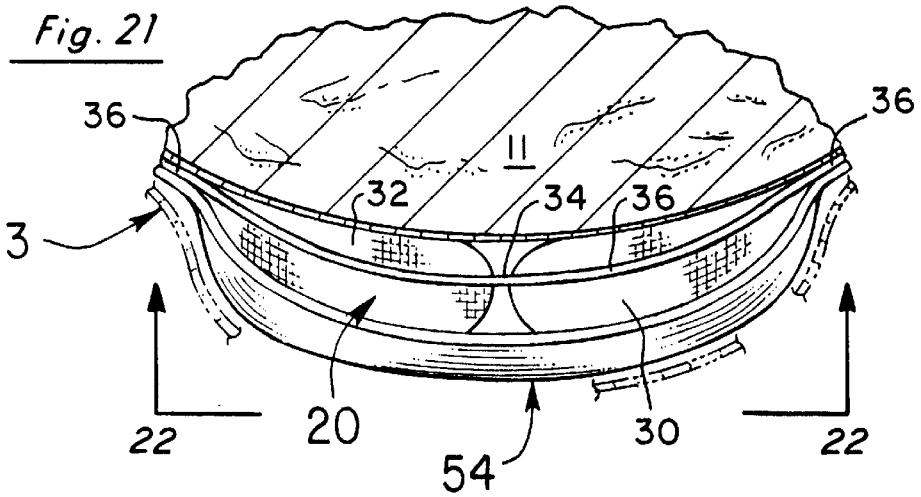
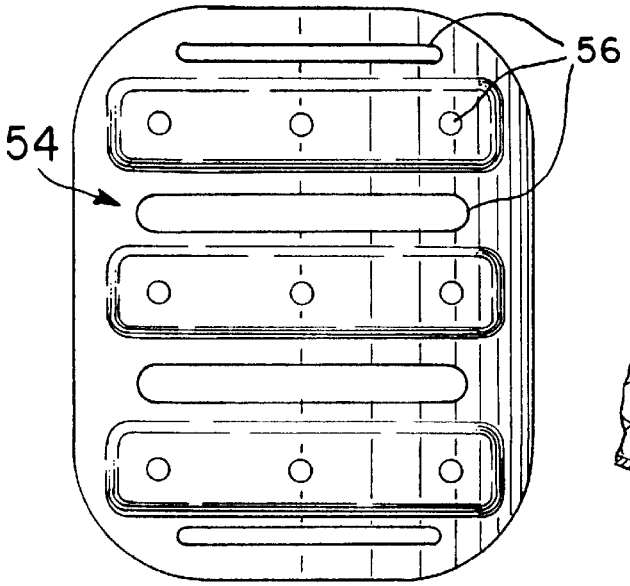
Fig. 22
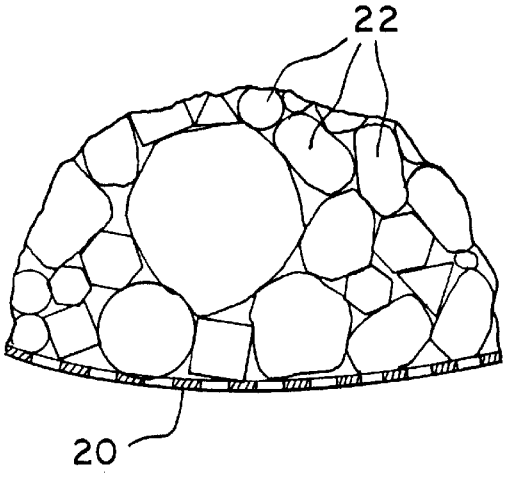
Fig. 23

Fig. 26
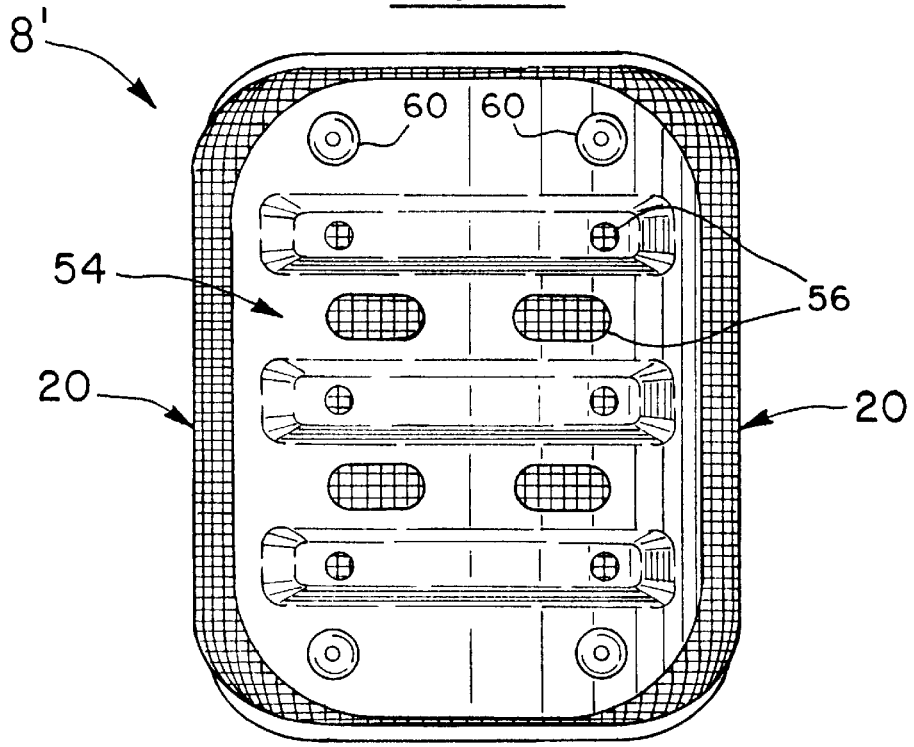
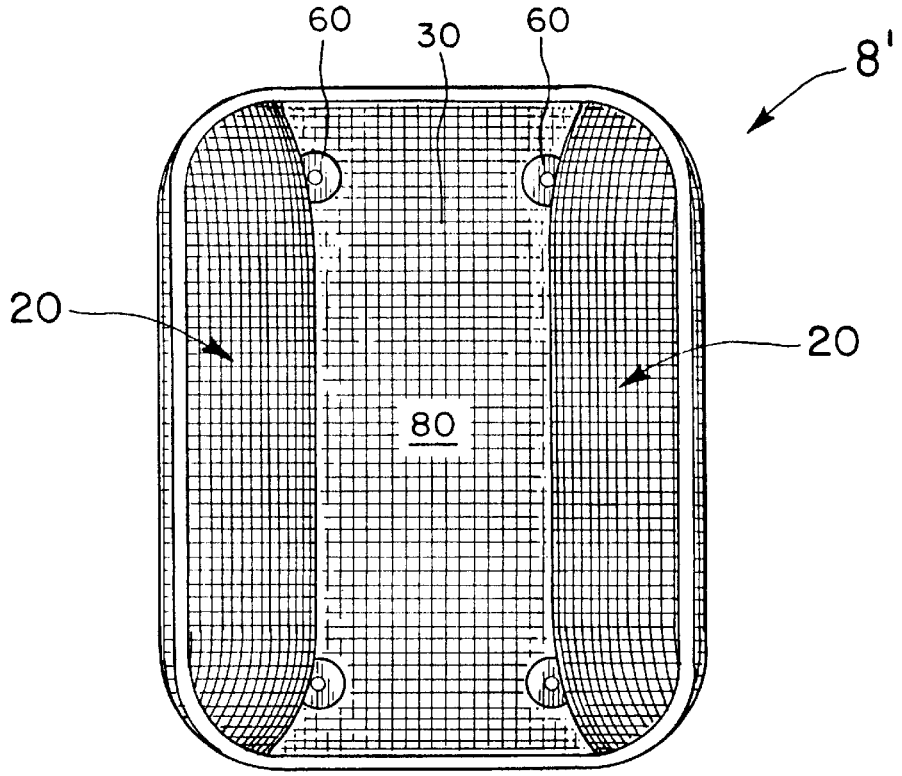
Fig. 27

1
60
6"
20
86
88'
90
9
20'
88
15
20
54'
20'
88'
20
60

60
90
86
6"
54'
20
20'
88
20
20'
20
60

60
86
6"
20
54'
20'
9
88

20
90
20'
20
15
60

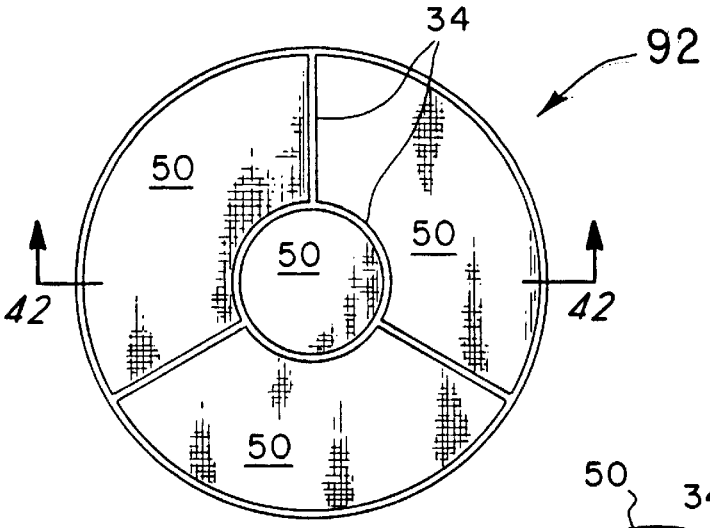
Fig. 41
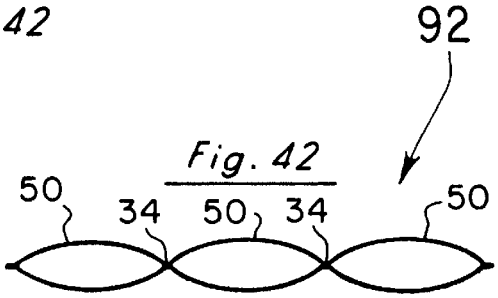
Fig. 42
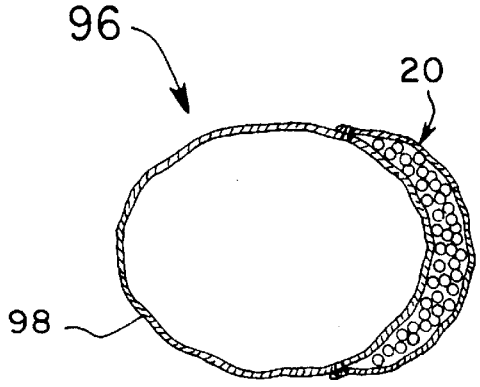
Fig. 43
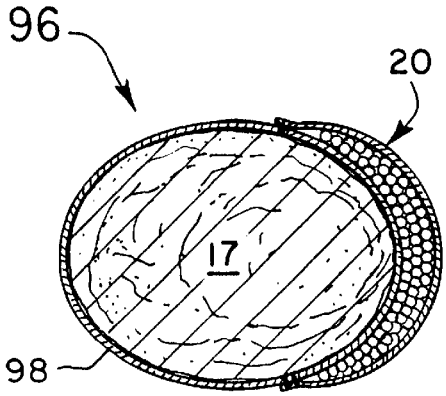
Fig. 44
Fig. 45
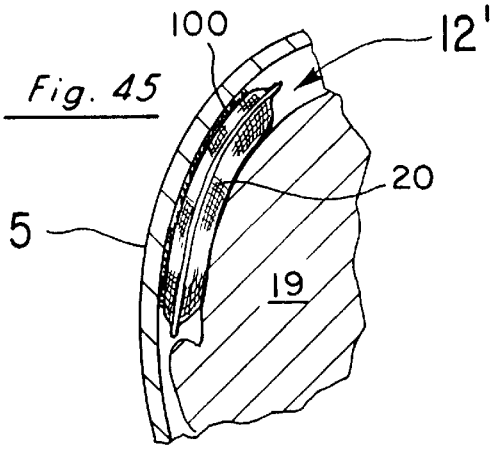
Fig. 46
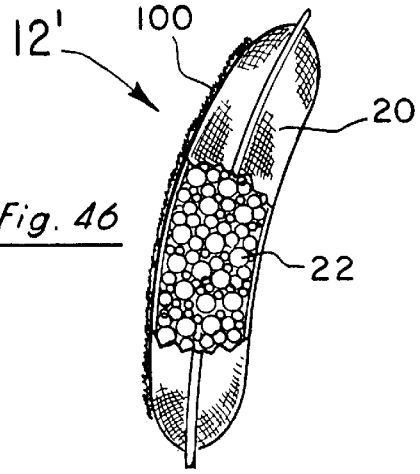

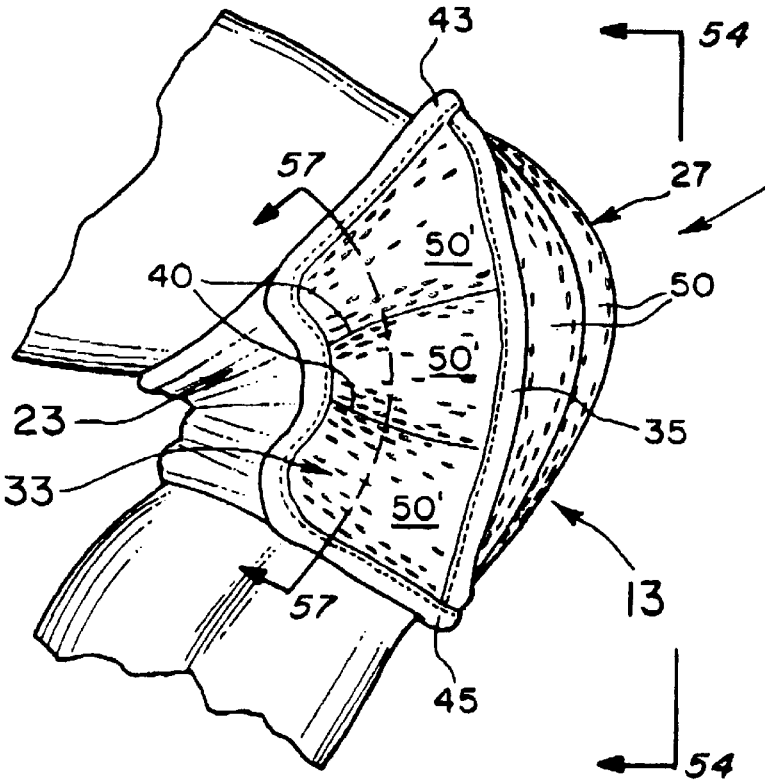
Fig. 53
Fig. 54
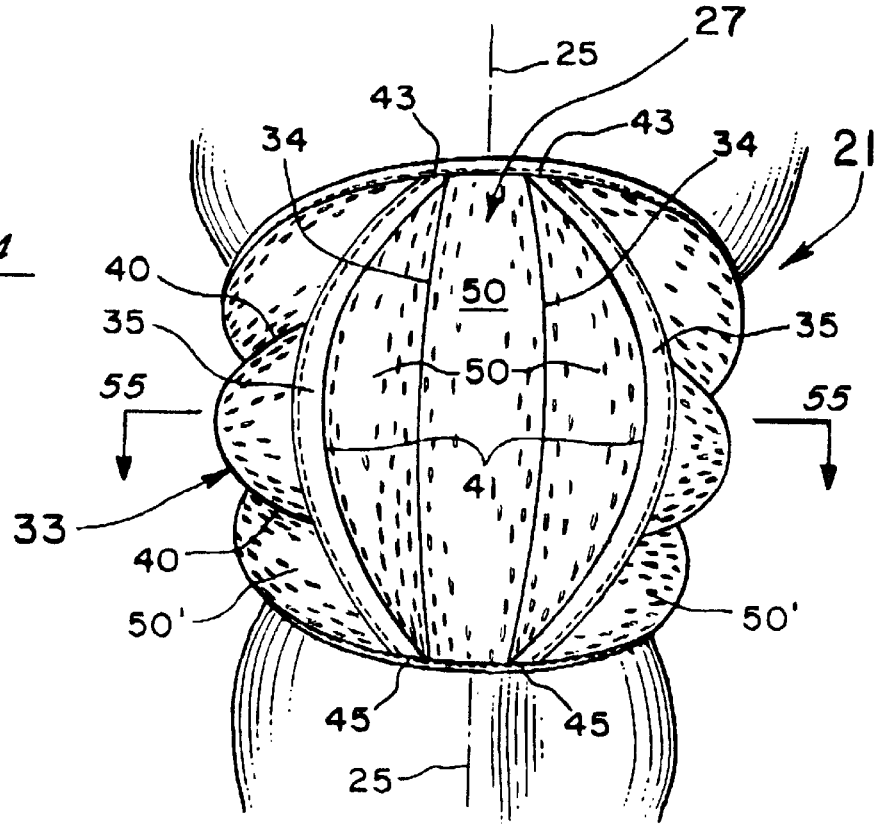

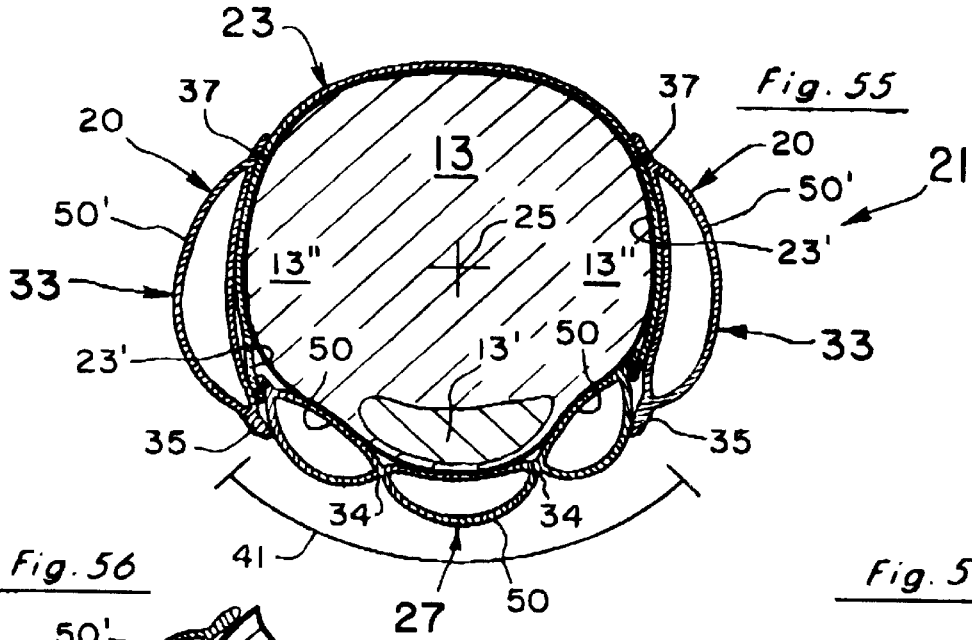
Fig. 55
Fig. 56
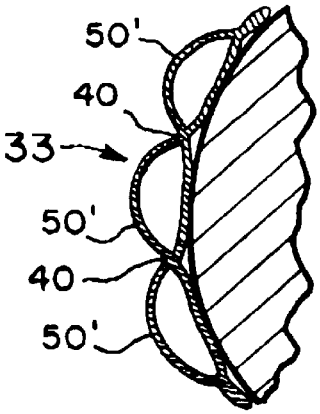
Fig. 57
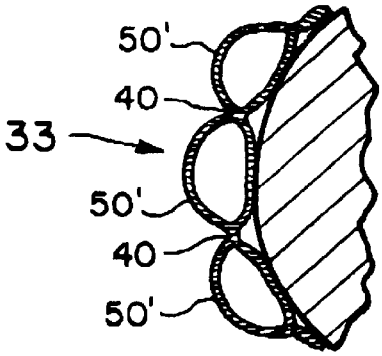
Fig. 58
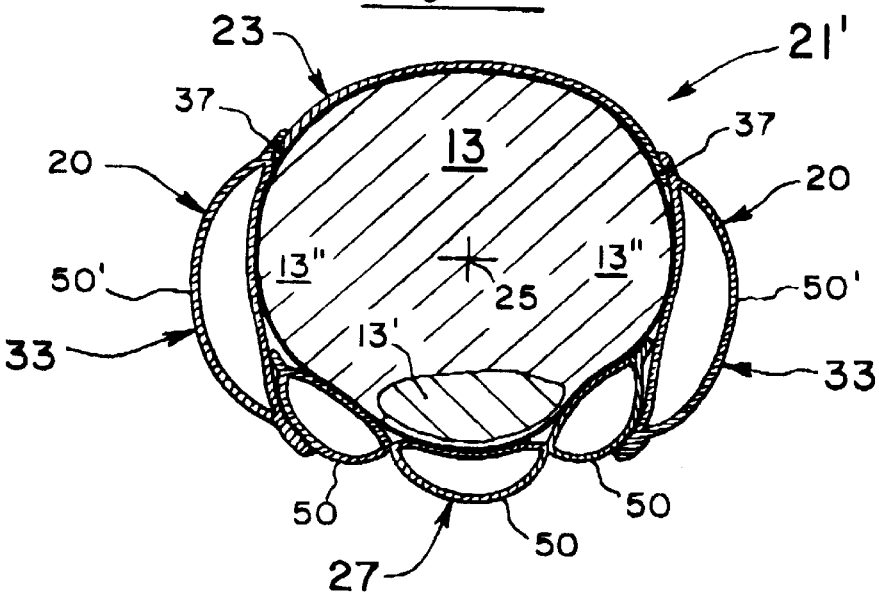

Fig. 59
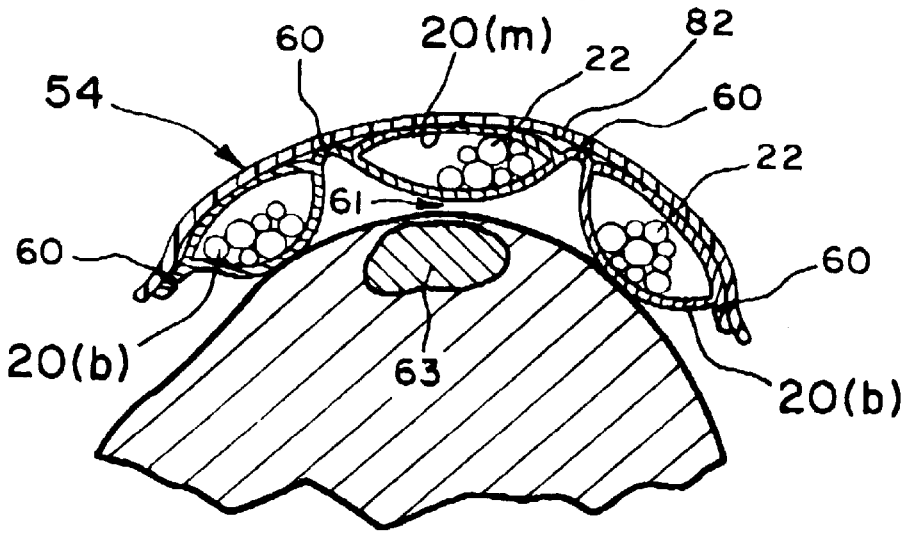
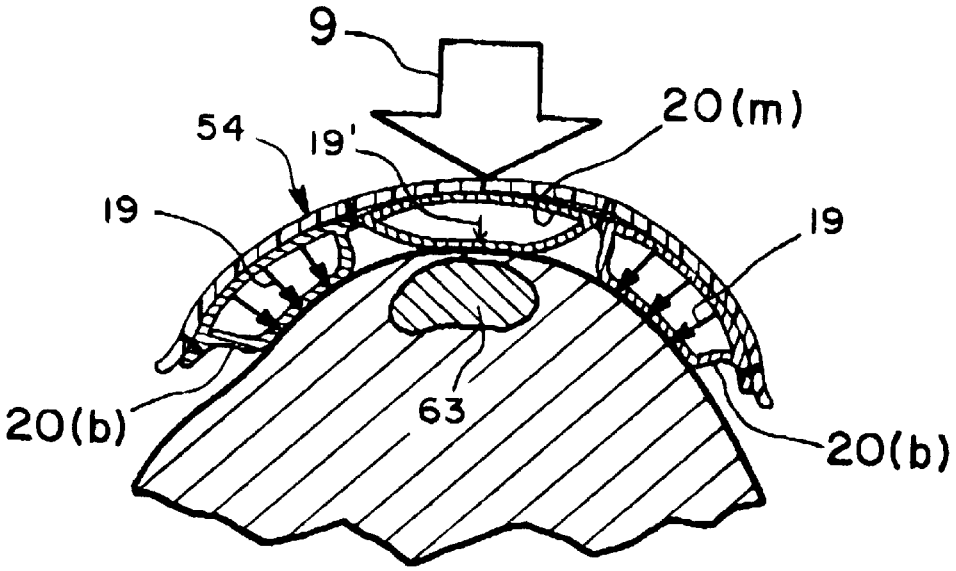
Fig. 60

Fig. 61
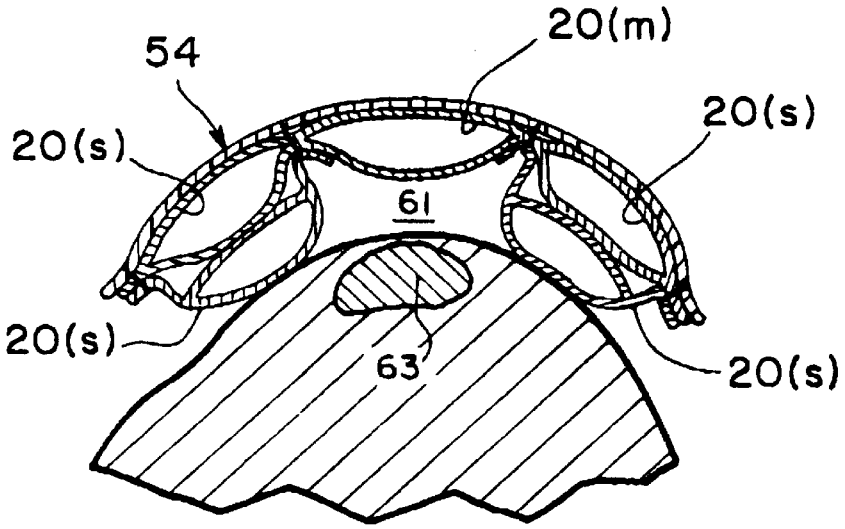
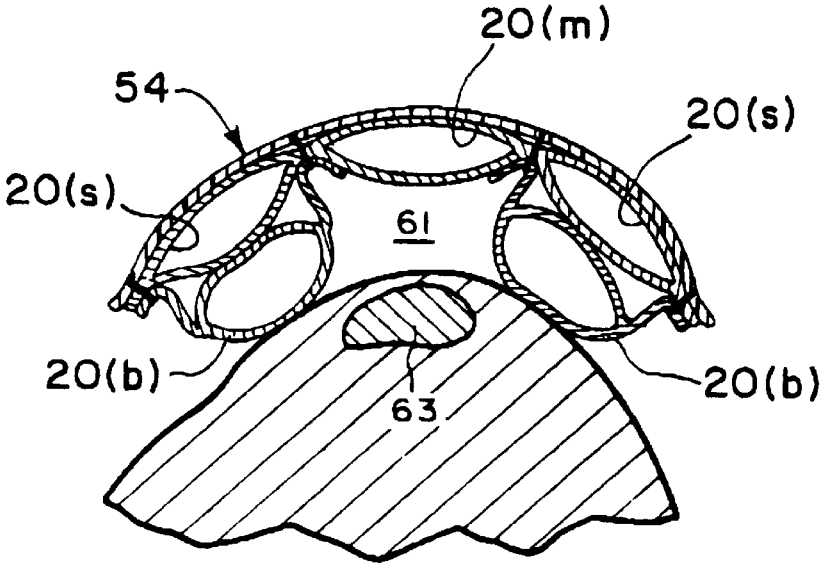
Fig. 62

81
77
73
75
79
83
65
20(v)"
20(v)'
20(v)
20(s)
20(b)'
64

54
20(m)
20(s)
20(b)
63
69
67
71
9

PROTECTIVE PADDING FOR SPORTS GEAR

RELATED APPLICATIONS

This application is a continuation-in-part of U.S. patent application Ser. No. 09/226,311 filed Jan. 7, 1999, which is a continuation-in-part of U.S. patent application Ser. No. 09/158,088 filed Sep. 22, 1998.

BACKGROUND OF THE INVENTION

1. Field of the Invention

This invention relates to the field of padding and more particularly, to the field of protective padding for sports gear.

2. Discussion of the Background

Designing protective padding for sports gear presents numerous challenges. In addition to having the padding perform its primary function of repeatedly absorbing and dissipating high impact forces, such padding would ideally be lightweight, breathable, and washable. Further, it would preferably be easily integrated into sports gear such as jerseys, pants, and helmets as well as be adaptable for specialized uses such as removable knee and elbow pads. All of the above would be accomplished in a manner that would not unduly inhibit the athlete's movements and dexterity on the field.

Many prior art pads and padding techniques accomplish some but not all of these goals. For example, U.S. Pat. No. 4,343,047 to Lazowski uses loosely filled, lightweight beads in a breathable casing to form a helmet pad. The helmet pad easily conforms to the contours of the wearer's head and in use, the loose beads are designed to move or shift around relative to each other within the casing. The beads are also designed to be crushed to absorb and attenuate high impact loads and forces. Such crushable padding is essentially effective for only one application and one impact situation, much like a car airbag in an emergency. As a practical matter, such padding cannot be used for other athletic gear such as football pants with thigh and knee pads that must withstand and be effective under repeated blows and impacts without losing their integrity.

Other prior art pads use incompressible beads that are designed not to be crushed (e.g., British Patent No. 1,378,494 to Bolton, U.S. Pat. No. 3,459,179 to Olesen, and U.S. Pat. No. 4,139,920 to Evans). Still others use compressible beads that are also designed not to be crushed such as U.S. Pat. No. 3,552,044 to Wiele and U.S. Pat. No. 5,079,787 to Pollman. However, in each case, the beads are loosely packed to allow the beads to move or roll relative to each other in an effort to achieve maximum conformation to the shape of the particular body part. Wiele in this regard even lubricates his beads to enhance their flowability. The thrust of these underfilled pads as expressed by Olesen, Wiele, and Pollman is to achieve padding with the flow and conforming characteristics of liquid-filled pads, but without the undesirable weight of such heavy fillings. Liquid-filled pads also necessarily require waterproof casings that make them unduly hot in use as they do not breathe. While such pads of loosely filled beads essentially conform like a liquid, the underfilled beads in them have an undesirable tendency to move out of the way in use. This tendency reduces the thickness of the padding around the body part and can even allow the body part to bottom out in the pad. In such a case, the beads essentially move completely out of the way and the only protection left is simply the two layers of the casing for the pad. This is particularly true when used for impact padding where the blows tend to occur repeatedly at the same location. Such loose-filled pads for the most part are ineffective for such uses.

In the athletic field today, the standard padding used is one or more sheets or layers of foam. Foam in this regard has the distinct advantages of being lightweight and relatively inexpensive. For the most part, there are two types of such foam padding. The first is closed cell which has the advantage of not absorbing moisture or other fluids. However, layers of closed-cell foam tend to be stiff and do not conform well to the body, particularly when the athlete is active. They also do not breathe to dissipate body heat and generally cannot be sewn into or washable with the athlete's uniform. The second type of commonly used foam is opened cell. These foams tend to be softer and more pliable than closed cell foams; however, they absorb moisture and odor and generally need to be coated with a waterproof material (e.g., vinyl). This coating then makes the pads non-breathable and very hot.

With these and other concerns in mind, the padding of the present invention was developed and specifically adapted for use in sports gear. The padding of the present invention involves both overfilled pads (i.e., filled more than a simple gravity fill or 100% full) and pads with no more than a gravity fill. Both sets of pads can be used alone or with hard, outer shells; however, most of the overfilled applications do not use a hard, outer shell while most of the gravity filled (and under gravity filled) applications are preferably used in combination with a hard, outer shell. In the preferred embodiments of the overfilled, gravity filled, and under gravity filled padding, the adjacent beads within the pads preferably maintain their relative positioning in use (i.e., they do not flow or migrate relative to each other). The beads in this regard essentially maintain or stay in their positions relative to each other and just vary their degree or amount of compression. This in turn helps to prevent the pads from bottoming out in use. The present padding is lightweight, breathable, and washable. It can also be easily incorporated to protect a variety of body parts, all without unduly inhibiting the athlete's movements and actions. The padding is relatively simple and inexpensive to manufacture and can be easily integrated into nearly all sports gear.

SUMMARY OF THE INVENTION

This invention involves protective padding primarily intended for use in sports gear. In a first set of preferred embodiments, the pads include flexible, outer casings of porous, breathable, inelastic material overfilled with resilient, discrete beads of elastic material. The beads are initially in compressed states within the casing and place the outer, inelastic casing in tension. When a blow or force is applied, the beads are further compressed to absorb and dissipate the impact. Additionally, the applied blow or force will increase the tension in the outer casing to even further compress the elastic beads for better absorption and dissipation of the impact. In use, the porous pads are compressed and rebound to create a pumping effect that circulates air into and out of the pads drawing heat and perspiration from the athlete's body and keeping the athlete cool and dry. If desired, the pads can be secured directly to the athlete's jersey or other article of clothing to enhance this pumping effect as well as the dissipation of the force of any impact. In an alternate embodiment, the outer casing is made of an elastic material that is overfilled to its elastic limit to act in the manner of the preferred embodiments. In a second set of preferred embodiments, the outer casings of the pads are actually filled no more than a simple gravity fill (i.e., 100%)

and preferably are underfilled (e.g., 90%) to less than a gravity fill. This second set of pads is preferably used in combination with a hard, outer shell. Variations of the basic features of the first and second sets of pads are also disclosed. All of the pads of the present invention are lightweight and washable and can be adapted and integrated into a wide variety of items.

BRIEF DESCRIPTION OF THE DRAWINGS

FIG. 4 is a further illustration of the pad of FIG. 2 showing its segmenting.

FIG. 5 is a cross-sectional view taken along line 5—5 of FIG. 4.

FIG. 6 illustrates the knee pad of FIG. 1 incorporating the padding technology of the present invention.

FIG. 7 is a cross-sectional view taken along line 7—7 of FIG. 6.

FIG. 8 is a cross-sectional view taken along line 8—8 of FIG. 6.

FIG. 10 schematically illustrates the increased compression forces applied by the casing as it is further tensioned by the applied blow.

FIG. 11 schematically shows the dissipation and reduction of the applied blow as received by the athlete's body.

FIGS. 16 and 17 are views similar to FIGS. 14 and 15 with boundary portions of the pad attached to the jersey to further enhance the pumping action.

FIG. 18 illustrates an additional advantage of securing the pad to the jersey wherein the jersey is pulled or drawn in by the pad to further dissipate the force of any impact.

FIG. 19 schematically illustrates the multi-directional movement of air into and out of the pads of the present invention.

FIG. 20 illustrates one method of making the overfilled pads of the present invention.

FIG. 21 shows a pad according to the present invention used in combination with an outer, hard shell.

FIG. 22 is a view taken along line 22—22 of FIG. 21.

FIG. 23 illustrates the use of discrete beads of different shapes and sizes.

FIG. 24 in this regard is a view taken along line 24—24 of FIG. 1 showing thigh padding constructed in accordance with this second set.

FIG. 26 is a view taken along line 26—26 of FIG. 24.

FIG. 27 is a view taken along line 27—27 of FIG. 24.

FIGS. 41–42 show the present invention adapted for use in a doughnut shaped pad.

FIGS. 43–44 illustrate a method in which an overfilled casing can be created from an initially unfilled or gravity filled one.

FIGS. 45–46 show a modified pad in which the beads are fused together into a desired shape.

FIG. 53 is a view similar to FIG. 52 showing the knee joint in a flexed or bent position.

FIG. 54 is a front view of the flexed knee and articulated pad of FIG. 53.

FIG. 55 is a cross-sectional view taken along line 55—55 of FIG. 54.

FIG. 56 is a view taken along line 56—56 of FIG. 52.

FIG. 57 is a view taken along line 57—57 of FIG. 53.

FIG. 58 is a view similar to FIG. 50 showing a modified, articulated pad.

FIG. 59 is a cross-sectional view of another adaptation of the present invention using a bridge-like structure and shell to protect a particularly vulnerable body part such as the end of a clavicle at the shoulder.

FIG. 60 is a view similar to FIG. 59 showing the manner in which a blow or impact to the pad is distributed and absorbed by the user's body.

FIG. 61 illustrates a modified version of the pad of FIG. 59.

FIG. 62 shows a further modification of the pad of FIG. 59.

DETAILED DESCRIPTION OF THE PREFERRED EMBODIMENTS

Figure 1:
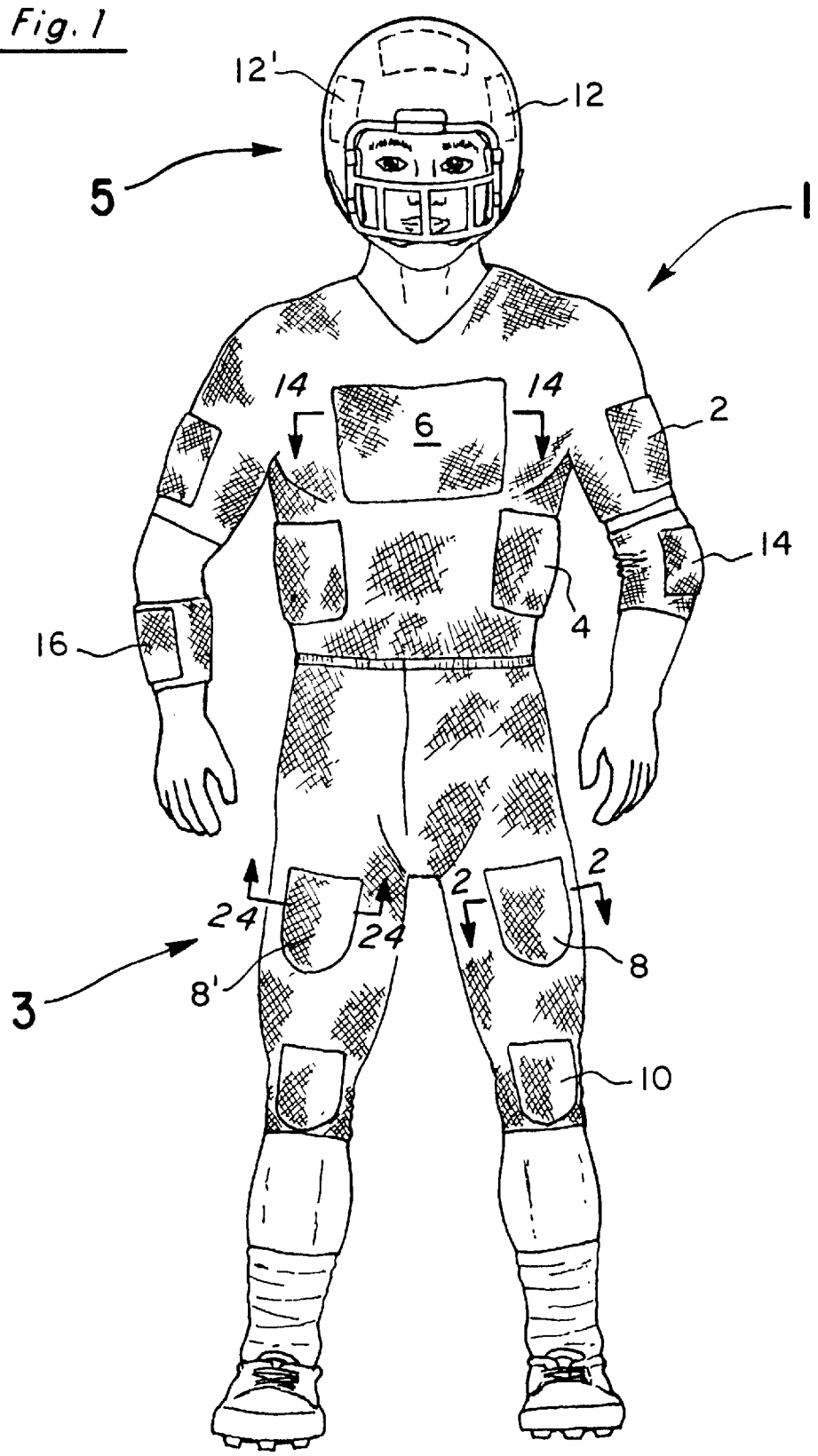
FIG. 1 illustrates the padding technology of the present invention adapted and integrated into sports gear for football.

FIG. 1 illustrates the padding technology of the present invention adapted and integrated into sports gear for football. The particular gear shown in FIG. 1 includes an under or liner jersey 1 with upper arm 2, rib 4, and sternum 6 pads. The illustrated gear also includes liner pants 3 with thigh 8 and knee 10 pads and helmet 5 with head pads 12. Liner gear such as jersey 1 and pants 3 are commonly worn by football players next to their bodies. Full shoulder pads and exterior or playing jerseys and pants are then worn over the liner gear and can also be padded according to the present invention. The current technology additionally can be easily adapted for use in nearly any and all other types of padding including separate and removable ones such as elbow 14 and forearm 16 pads in FIG. 1.

Figure 2:
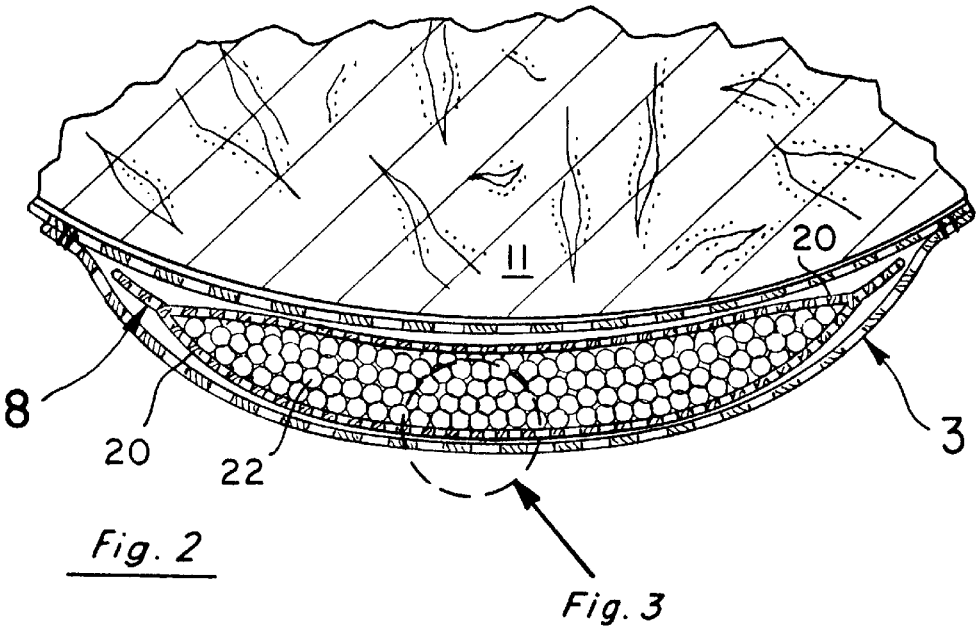
FIG. 2 is a cross-sectional view of the thigh pad of FIG. 1 taken along line 2—2 of FIG. 1.

The basic structure of the first set of protective pads of FIGS. 1–23 of the present invention as typified by the thigh pad 8 in FIGS. 1 and 2 includes an outer casing 20 (see FIG. 2) which is overfilled with beads 22. In use, the entire pad 8 is then received or sewn into a pocket in the pants 3. The outer casing 20 of the pad 8 is preferably made of a porous, breathable, and flexible material that is substantially inelastic. In the preferred embodiment, the casing 20 is a plastic mesh of a substantially waterproof material as polypropylene which is heat sealable. Other substantially inelastic, porous, and flexible materials could also be used if desired such as woven or unwoven fiberglass, polyester, or nylon yarns preferably coated with PVC to make them heat sealable and waterproof. The casing 20 is overfilled with soft, resilient, discrete beads 22 of elastic material. The beads 22 are also preferably made of lightweight and waterproof material (e.g., a closed-cell foam such as polypropylene). In this manner and although the pad 8 is extremely porous, the casing 20 and beads 22 of the pad 8 do not absorb water, other liquids, or odors and the entire pad 8 can be washed and dried with the pants 3 and the rest of the gear of FIG. 1. The beads 22 can be of a variety of different shapes and sizes but preferably are spherical beads ranging in diameter from about 0.05 to about 0.5 inches. Depending upon the application, the beads could be smaller or larger but would still have the operating characteristics discussed below. The pores of the outer casing 20 are preferably as large as possible without allowing the beads 22 to pass through them during use.

The beads 22 are overfilled in the casing 20 meaning that the fill is higher than a simple gravity fill. Consequently, substantially all of the resilient beads 22 are in compression. The actual overfill above 100% can be up to 160% or more but is preferably about 120%. As illustrated in the enlarged view of FIG. 3, this leaves the compressed, spherical beads 22 of the preferred embodiments slightly distorted or flattened on the abutting portions 24 while the spaced-apart portions create the interstitial spaces 26 therebetween. Each bead 22 is thus compressed to under 100% to about 40% of its relaxed, uncompressed volume. Preferably, the compression is about 80% of the relaxed volume. The total volume of the interstitial spaces 26 under a gravity fill can be on the order of 35% of the casing volume. With the beads 22 initially compressed, this interstitial volume is then less than about 35% down to about 5% of the volume of the casing 20. Preferably, the interstitial volume is about 25%–30% of the casing volume with the compressed beads 22 then occupying the remaining volume of the casing 20.

The opposing portions 30 and 32 of the casing 20 in the thigh pad 8 as shown in FIGS. 4 and 5 are preferably segmented or joined by seams 34. Such segmenting or joining of the opposing portions 30 and 32 within the pad boundary 36 helps to prevent the pad 8 from ballooning. Depending upon the spacing of the segments 34, the cross-sectional shapes of the individually padded areas or pouches of the pad 8 can be varied to create nearly circular ones like 38 in FIG. 5 or more elongated ones such as shown in FIG. 2. (For clarity, the beads 22 are illustrated in FIG. 5 in only one of the pouches 38 but the beads 22 would be in all of the pouches 38.) The segmenting or joining at linear seams 34 also provides predetermined fold lines or patterns to help the pads conform better to the curved shapes of the user's body such as to his or her thigh 11 in FIG. 5. Such conformation gives the thigh pad 8 less of a tendency to rotate or otherwise move out of place. This is particularly important for the pads protecting joints such as the knee pad 10 in FIGS. 6–8. As illustrated the knee pad 10 is provided not only with a vertical segment or seam 34 but also with horizontal seams 40 and spot or dot attachments 42. Vertical segment 34 in FIG. 6 helps the knee pad 10 to conform about the knee 13 (FIG. 7) while the substantially perpendicular or horizontal segments 40 (FIG. 8) aid the pad 10 to bend with the natural flex of the knee joint. Spot or dot attachments 42 help to keep the pad 10 from ballooning.

Figure 3:
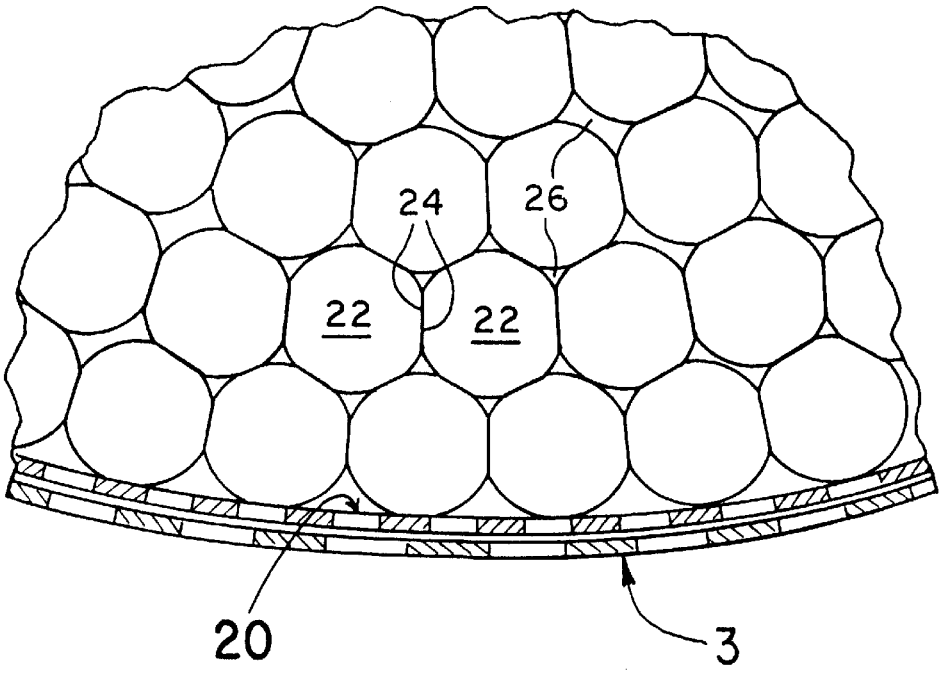
FIG. 3 is an enlarged, cutaway view of the pad of FIG. 2 showing the initially compressed state of the beads in it.

The initially compressed beads 22 of FIGS. 2 and 3 within the casing 20 serve to place the outer, inelastic casing 20 in tension. This has the beneficial result of aiding in the absorption and dissipation of any blow applied to the pad. More specifically and referring to FIG. 9 (in which only the pad 8 and athlete's thigh 11 are shown for clarity), any impact or blow 9 to the casing 20 will depress the inelastic casing 20 at the point of the blow 9. This depression in turn will draw in the casing 20 immediately to the sides 44 and 46 of the blow 9. The force applied by the blow 9 in FIG. 9 will then be absorbed and dissipated by the beads 22' directly under the blow 9 and by the surrounding beads 22", which will be further compressed by the increased tension in the casing 20 as explained below.

Figure 9:
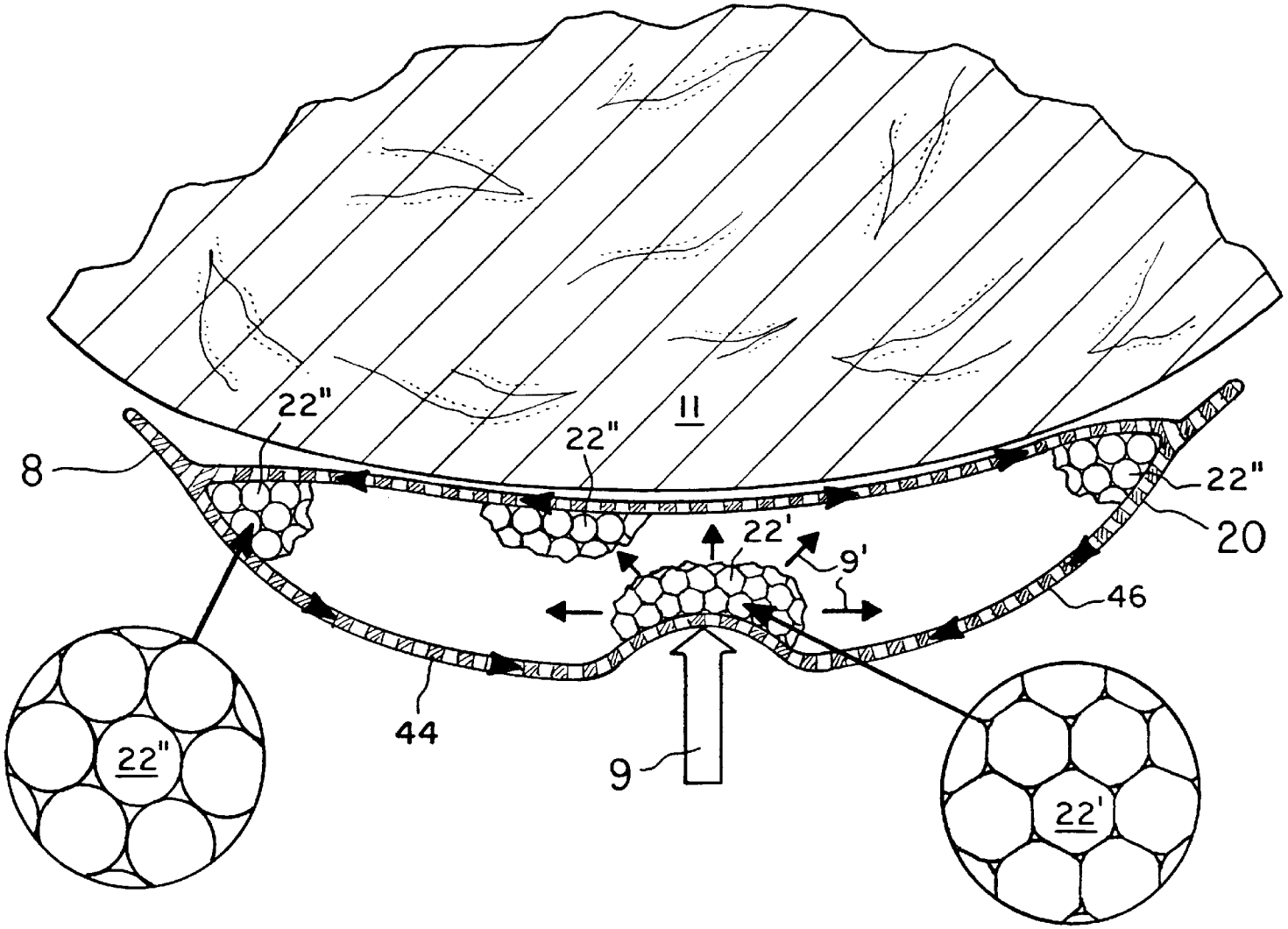
FIG. 9 is an enlarged view of the pad of FIG. 2 initially receiving a blow or impact.

More specifically, the beads 22' directly under the blow 9 in FIG. 9 will first and foremost be further compressed by the blow 9 from their initially compressed state as in FIG. 3 to that of FIG. 9. These further compressed beads 22' at the point of blow 9 in FIG. 9 will then send or radiate compressive forces 9' outwardly to the remaining beads 22". These remaining or surrounding beads 22" in turn will be further compressed from their initial states by the radiating forces 9' acting on the beads 22" against the retaining force of the inelastic casing 20. This radiating action is essentially an inside-out one. Additionally, and because the casing 20 is inelastic and does not stretch, the blow 9 will draw in the casing 20 immediately to the sides 44 and 46 of the blow 9. This movement of sides 44 and 46 will reduce the casing volume and further tension the casing 20. It will also cause the casing 20 to increase the compression of the beads 22", essentially by applying forces 9" as illustrated in FIG. 10 from the outside-in. In these manners, the initial force of the blow 9 will be absorbed and dissipated within the pad 8 and the forces actually transferred to the athlete will be greatly reduced as schematically illustrated by forces 19 in FIG. 11. Preliminary tests show this reduction to be quite significant over the currently most popular pads and padding. Further, because of the resiliency of the discrete beads 22' and 22" in FIG. 9, the propagation of the force through the pad 8 is slower than through a pad, for example, composed of simply a layer of foam. This slower propagation speed helps to further dissipate the impact.

In use, the pads of the present invention offer still other unique advantages. Because the pads are overfilled and the casings initially tensioned, the pads are biased toward a first shape and volume. That is, when unimpeded by any external forces, each pad will assume a first, predetermined shape such as the symmetrical one illustrated in FIG. 12. Depending upon the amount of overfill of the beads 22 and other factors such as the relative stiffness of the casing 20 and the relative spacing of any segments 34, the unrestrained, single pouch 50 of the pad in FIG. 12 tends toward a nearly circular cross section. Even under mild restraints such as the pants 3 on the motionless athlete of FIGS. 1 and 5, the multiple pouches 38 of the thigh pad 8 in FIG. 5 are still individually biased toward a first or free shape such as in FIG. 12. Such bias for the most part is provided by the outwardly directed forces of the compressed beads 22 acting against each other and against the flexible but inelastic, outer casing 20.

In a like manner, even the more flattened or elongated pouch of pad 8 in FIGS. 2 and 10 is biased toward a first shape and volume. Consequently, if a blow such as 9 in FIG. 10 is delivered compressing the pad 8 (as shown in dotted lines in schematic FIG. 10), the pad 8 upon dissipation of the blow 9 will automatically rebound to the original shape and volume shown in solid lines in FIG. 10. (For clarity, only the athlete's thigh 11 and the elongated pouch of pad 8 are shown in this schematic FIG. 10.) Because the casing 20 is porous and breathable and because the compressible beads 22 form interstitial spaces 26, this action on the pad 8 will have a desirable pumping effect. Such effect will force or pump air out of the pad 8 during the compression of blow 9 and draw in ambient air during the return or rebound toward the original shape.

This pumping effect also occurs with any natural movement of the athlete that tends to further compress and then release the pad (e.g., flexing and unflexing the knee in FIG. 8 during running). Such movement, as with a blow, first compresses the beads 22 further and reduces the total volumes of the casing 20 and the interstitial spaces 26. The resilient beads 22 then rebound to their initial state and volume returning the casing 20 and interstitial spaces 26 to their original volumes. This action is a pumping one and has its most beneficial effect around the jersey 1 to help dissipate and draw or wick away the athlete's body heat and perspiration. More specifically and referring to the chest or sternum pad 6 of FIGS. 1 and 13, the pad 6 would typically have a plurality of individual, completely compartmentalized pouches 50 (see FIG. 13). These individual pouches 50 would be separated by vertical and horizontal seams 34 and 40. In use as illustrated schematically in FIG. 14 and 15 (in which the pouch beads are not shown for clarity), the pouches 50 of the pad 6 alternately expel and draw in air. That is, at maximum inhalation or movement, the lateral or side-by-side array of pouches 50 in the jersey pocket 1 in FIG. 14 would assume compressed positions or shapes pumping air along with body heat and perspiration out of the pouches 50 and through the porous, mesh jersey 1. During simple breathing, this compression is caused primarily by the already tightly fitting jersey 1 being drawn even tighter about the athlete's chest 15 during inhalation. Upon exhaling, the pouches 50 naturally return or rebound to the positions of FIG. 15 drawing or pumping in ambient air. With each breath and/or movement, the process is repeated, cooling and drying the athlete's body.

To further enhance the pumping effect of the pads of the present invention, boundary or other spaced-apart portions of the pads can be secured if desired to move with the particular article of clothing such as jersey 1. For example, by actually sewing or otherwise securing opposing boundary portions 36' of the pad 6 in FIGS. 16 and 17 to spaced-apart portions of the flexible jersey 1, the stretch or pull of the elastic jersey 1 at 51 during even normal breathing will enhance the contraction of the pad 6 (FIG. 16) and its overall pumping action (FIGS. 16–17). Such securing also helps to keep the particular pad firmly and properly in place in the jersey 1 or other article or articles of clothing (such as items 3, 5, 14, and 16 of FIG. 1, or similar ones).

Further, the securing of the pad such as 6 in FIGS. 16 and 17 to the jersey 1 integrates the jersey 1 into the pad 6 and in essence makes the jersey an extension of the pad casing 20. Consequently, during an impact 9 as in FIG. 18, the casing 20 reacts in the manner of FIG. 9 drawing in the casing sides 44 and 46 immediately adjacent the blow 9; and, because the inelastic casing 20 is secured at each side 36' to the jersey 1, the jersey 1 is also drawn in at 52. The jersey 1 about the athlete's chest 15 then acts with and under the influence of the casing 20 to further dissipate the force of the impact 9. The impact 9 in FIG. 18 is shown striking the far left pouch 50 for illustrative purposes. However, depending upon where the impact strikes across the pad 6 and how broad the impact is, the jersey 1 would be pulled or drawn in to different degrees from all directions or sides 36' about the pad 6. If the pad 6 is secured to the jersey 1 as in FIGS. 16–17, it can be done so directly without the need to form a pocket in the jersey 1 as in these FIGS. 16–17.

It is noted that FIGS. 16 and 17 schematically illustrate the pumping action of the pad 6 with arrows directed primarily away from and toward the athlete's chest 15. However, the pads of the present invention including pad 6 with pouches 50 in FIGS. 16 and 17 are extremely porous in all directions. Consequently, as schematically shown in FIG. 19, the air moving into and out of the pouch 50' of pad 6' (and every pad of the present invention) travels in all directions. In contrast, for example, sheets of closed-cell foam that are perforated in the fashion of swiss cheese may pass air through the holes but cannot pass air laterally through the foam sheet. To the extent the sheet is made of open-celled foam to pass air in all directions, it then has the distinct disadvantage of absorbing moisture and odor.

Figure 12:
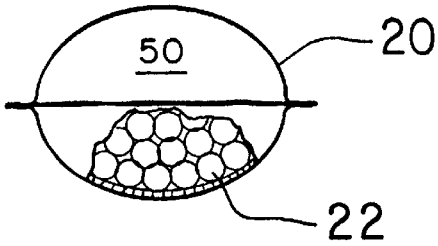
FIG. 12 illustrates a pad of the present invention with a single pouch that has a substantially circular cross section.
Figure 13:
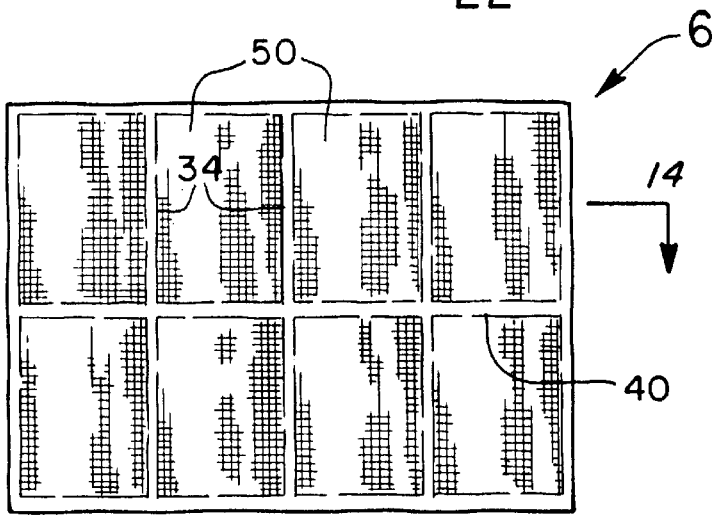
FIG. 13 shows the sternum pad of FIG. 1 incorporating the padding technology of the present invention.
Figure 14:
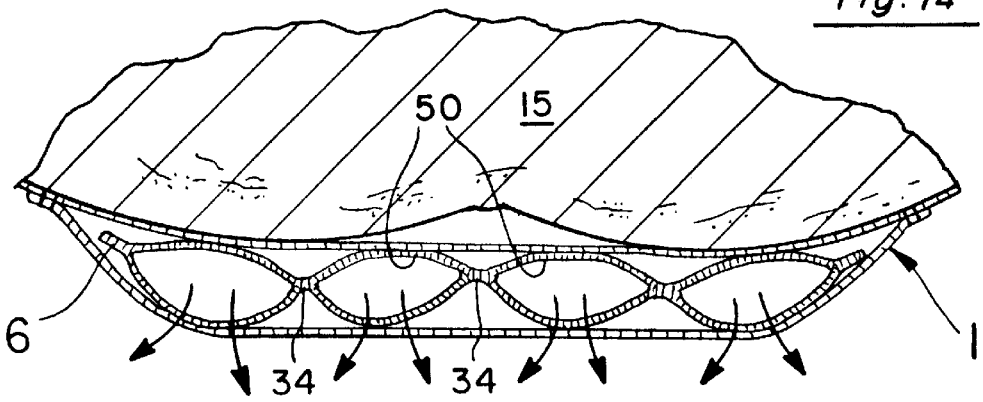
FIG. 14 is cross-sectional view taken along line 14—14 of FIGS. 1 and 13 showing the pouches of the pad substantially compressed to pump air out of them.
Figure 15:
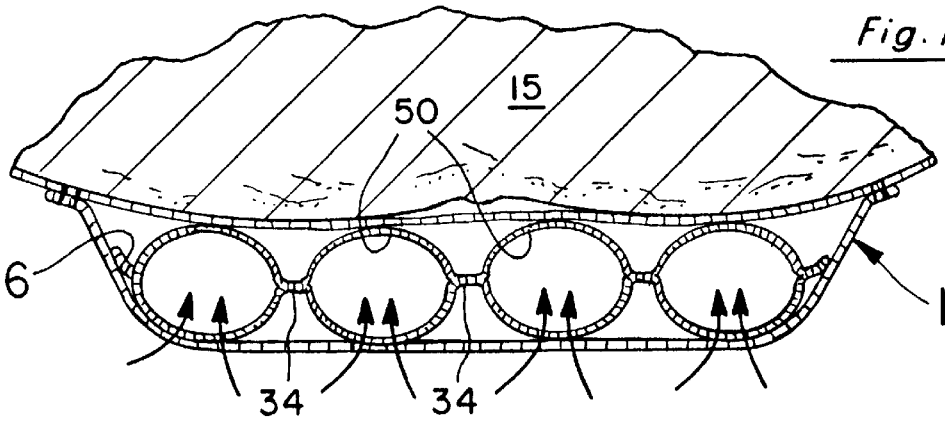
FIG. 15 is a view similar to FIG. 14 showing the pouches of the pad rebounding to their initial shape and volume to draw ambient air into them.

As discussed above, the prestressed or initially compressed condition of the elastic beads 22 in the free state of FIG. 12 tensions the inelastic, outer casing 20. In use, this also helps to prevent the beads 22 from moving relative to each other. The beads 22 in this regard essentially maintain or stay in their positions relative to each other and just vary their degree or amount of compression. Consequently, the overfilled pads of the present invention will not bottom out in use. This is an important feature of the pads, particularly as used in sports gear. Comfort of the pad against the athlete's body is also a concern. To the extent the casing 20 is made of relatively stiff material or material that tends to be abrasive or irritating to the athlete's skin, the jersey 1 in FIGS. 14 and 15 acts as a soft barrier to the casing 20. In other applications such as forearm or shin guards, an additional layer of soft material could be added if desired to the pads of the present invention between the casing 20 and the athlete's body.

The overfilling of the pads to compress the beads 22 and tension the outer casing 20 can be accomplished in a number of manners. The preferred and simplest method is to substantially, or completely, gravity fill the casing 20 as shown in solid lines in FIG. 20. The opposing sides 30 and 32 of the casing 20 can then be depressed or pinched to form the segment 34 (shown in dotted lines in FIG. 20). Thereafter, the segment 34 can be joined by heat sealing the sides 30 and 32 of the casing 20 together or by some other method such as sewing, stapling, or riveting. The segment 34 in this regard can extend partially across the pad as in FIGS. 4 and 6 or completely across the pad as in FIGS. 13–15 to make separate and distinct pouches 50. Single or unsegmented pads such as the pad in FIG. 12 can be made by simply cutting the segmented pad of FIG. 20 along the joined portion or seam 34 to form separate, individual pads. Other techniques to overfill the pads could also be used such as blowing, screwing, or ramming the beads under pressure into the pad to compress the beads and sealing the pad shut while the beads remain compressed. Multiple compression steps can also be performed as for example initially compressing the beads 22 by one of the above techniques and then further compressing them by adding more linear segments 34 or spot joining the opposing sides 30 and 32 of casing 20 with staples or rivets.

The padding technology of the present invention is equally adaptable for use under hard, outer shells such as those normally used in football shoulder pads and thigh pads. In adding an outer, hard shell 54 as illustrated in FIGS. 21 and 22, the shell 54 is preferably well perforated (see perforations 56 in FIG. 22) so as not to unduly reduce the breathability of the underlying pad 8. In use, the pad 8 with the outer, hard, porous shell 54 essentially operates as described above except that the initial impact force is immediately dissipated by the shell 54 and spread or applied to the pad 8 across a larger area than in the case of FIGS. 9–11. Lighter, less hard coverings or outer layers could also be used in place of the shell 54 if desired such as an additional mesh layer of relatively stiff material. The stiffness of the mesh of the casing 20 can also be varied as desired to be relatively soft or even approach the stiffness of a hard shell like 54. The stiffer the casing 20, the more it then acts like a hard shell 54 to spread out and dissipate the blow. When a hard shell 54 is used, it has been found desirable to use relatively soft beads 22 beneath the shell 54 so the overall padding does not become too hard. This is particularly advantageous in sports such as hockey in which nearly all the pads will have hard, outer shells 54. In such cases, the fact that air moves into and out of the pads in all directions (as schematically shown in FIG. 19) becomes very important as the hard shell 54, no matter how perforated or porous it is, tends to restrict air flow through it. However, with the pads of the present invention, the air movement then simply moves laterally or in all of the remaining directions not inhibited by the shell 54. In contrast as discussed above, closed-cell foam sheets perforated like Swiss cheese will have any air flow blocked by the shell and air cannot move laterally through the sheet. If the foam is made of open-celled foam, air may flow around the shell but the foam will then absorb moisture and odors.

While several embodiments of the present invention have been shown and described in detail, it is to be understood that various changes and modifications could be made without departing from the scope of the invention. For example, as mentioned above and illustrated in FIG. 23, the beads could be of different sizes and shapes (e.g., spheres, cubes, oblongs, pyramids, and cylinders). In this regard, it has been found with beads of closed-cell polypropylene, for example, that it is preferred to use smaller diameter beads (e.g., 0.125 inches) packed fairly tightly (e.g., 140% overfill) for areas in which impact absorption is paramount (e.g., knee). Conversely, larger diameter beads (0.25 inches) of polypropylene with less compaction (e.g., 110%–120%) have been found to work better for areas in which breathability is of primary importance, such as in the chest area, to dissipate the athlete's body heat. Such larger diameter beads of polypropylene also tend to be softer than smaller diameter ones. Other factors such as the stiffness of the casing 20 as discussed above can also be varied as desired. In this manner, pads using the technology of the present invention can be custom designed not only for particular uses but also for particular individuals.

Further, and although the casing 20 is preferably overfilled only with compressible beads 22, portions of the fill could be other items with other properties (e.g., incompressible) as long as the fill was predominantly of the preferred, resilient, elastic members or beads 22 to give the pads the desirable characteristics discussed above. Additionally, the casing 20 has been discussed above as being preferably made of inelastic material. However, the casing 20 can be made of an elastic material if desired that was also flexible, porous, and breathable. The elastic casing 20 would then be preferably overfilled and expanded substantially to its elastic limit to place the beads 22 in compression and the stretched casing 20 in tension. The casing 20 would then act substantially in the manner of an inelastic one and the overall pad would perform substantially as discussed above and as illustrated in FIGS. 1–23. It is further noted that the padding of the present invention has been primarily disclosed as adapted for use in sports gear but it is equally adaptable for use wherever foam and other padding are used. For example, the padding technology of the present invention could be used as pads for fences, poles, trees, and walls as well as in industrial applications such as elevators and vehicle bumpers.

Figure 24:
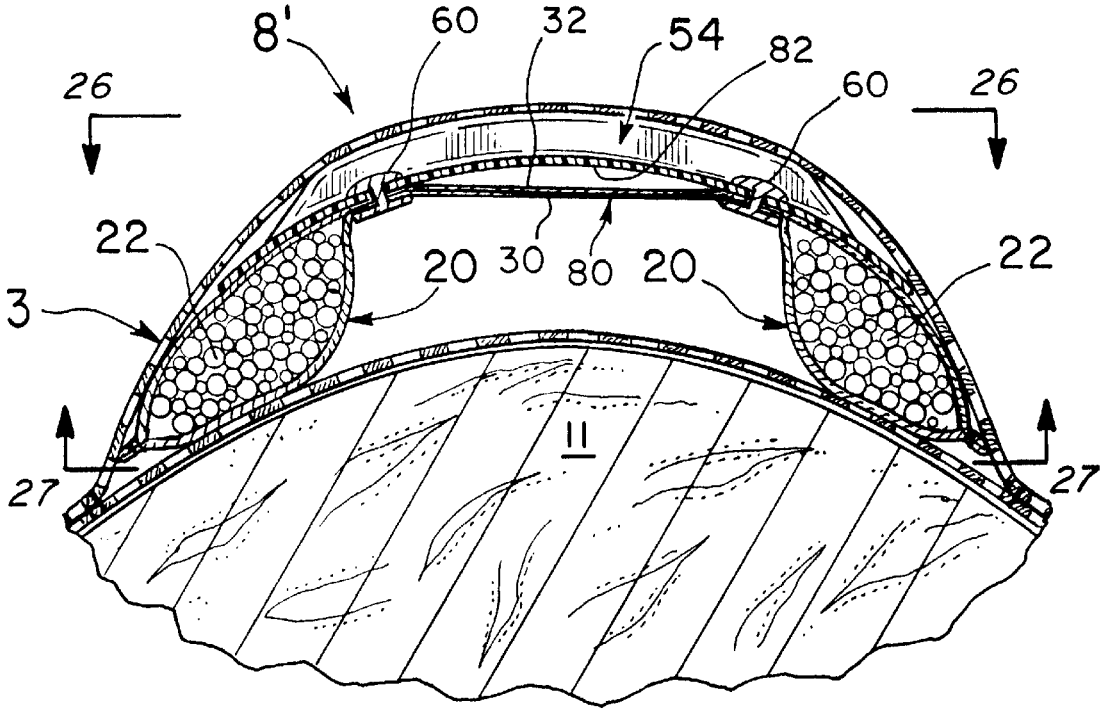
FIG. 24 illustrates a second set of protective padding of the present invention in which the pad casings are preferably underfilled (or at least filled no more than a gravity fill) and are preferably used in combination with hard, outer shells.
Figure 25:
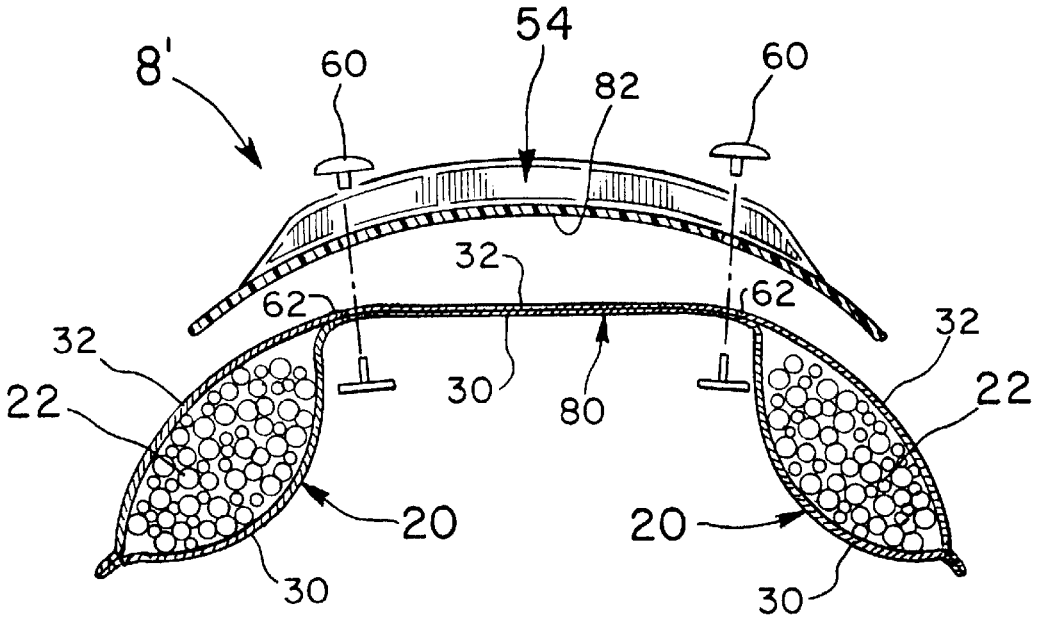
FIG. 25 is an exploded view of the thigh padding of FIG. 24.

Additionally, as best seen in FIGS. 24 and 25, a second set of protective padding of the present invention involves initially filling the inelastic casings 20 to no more than a simple gravity fill (i.e., 100%) and preferably underfilling the casings 20 to less (e.g., 90%) than a gravity fill. The casings 20 are then untensioned and substantially all of the beads 22 are uncompressed in the casings 20. This second set of protective padding with underfilled casings 20 (see FIGS. 24–27) is preferably used in combination with a hard, outer shell such as 54. Like the first set of protective padding of FIGS. 1–23, the casings 20 are preferably made of porous, breathable, and flexible material which is substantially inelastic. Similarly, the casing material is preferably a plastic mesh of a substantially waterproof material (e.g., polypropylene) that is heat sealable. The beads 22 are also preferably made of waterproof material (e.g., closed-cell, foam beads such as polypropylene). Like the pads of the first set of FIGS. 1–23, the casings 20 and beads 22 themselves do not absorb water; however, the overall pads themselves are extremely porous and breathable to help keep the athlete's body cool. In this regard, both air and water will easily pass or flow through the pad but will not be absorbed by any of its components, including the casings 20 and beads 22 of the pads.

FIG. 24 in this regard is a view taken along line 24—24 of FIG. 1 illustrating this second set of padding in use as thigh padding 8'. As shown, the padding 8' of FIG. 24 includes a hard, outer shell 54 to which the pair of casings 20 are attached by rivets 60. More specifically, as illustrated in the exploded view of FIG. 25, the two layers or portions 30 and 32 of the casings 20 are preferably heat sealed or sewn at 62 to form somewhat of a pontoon shape. Each pontoon casing 20 is then initially filled to no more than a gravity fill (i.e., 100%) and is preferably slightly underfilled (e.g., 80%–95% of a simple gravity fill). The casings 20 are preferably attached adjacent the joined areas 62 to the hard, outer shell 54. The shell 54 like the one of FIG. 22 is perforated at 56 (see FIG. 26) to be very porous so as not to unduly reduce the breathability of the overall padding 8'.

Figure 28:
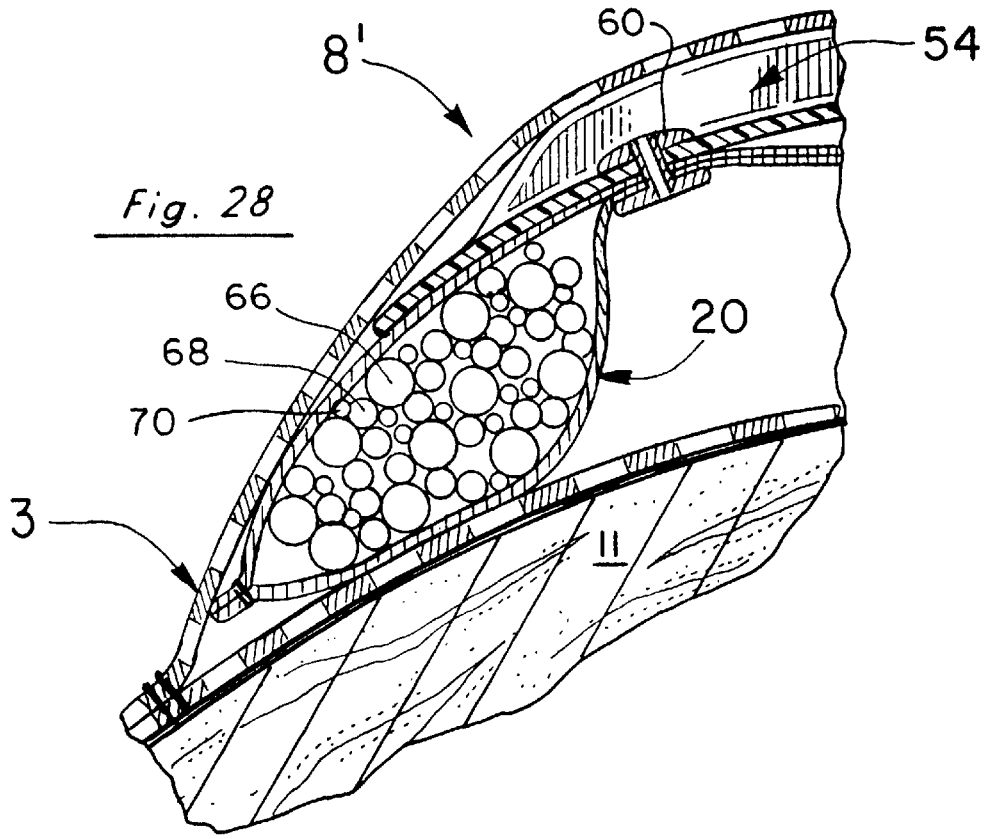
FIG. 28 is an enlarged view of one of the beaded casings of FIG. 24.
Figure 30:
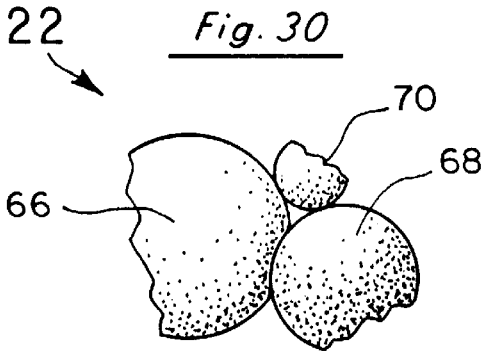
FIGS. 30–32 illustrate the manner in which the differently sized beads progressively compress to progressively absorb forces applied to them.
Figure 31:
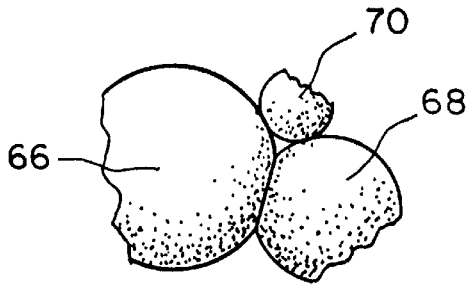
Figure 32:
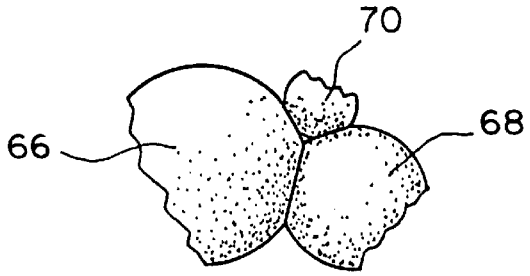

In the preferred embodiments of the second set of protective padding as typified by the padding 8' of FIGS. 24–27, the beads 22 are preferably blended and are a mix of different shapes as in FIG. 24 and/or at least two and preferably three, differently sized beads 66, 68, and 70 (see FIG. 28). The beads 66, 68, and 70 are preferably of grossly different sizes, as for example spheres with relative diameters of 1:2:3 (e.g., 1/12:1/6:1/4 inches). When the beads are made of the same material (e.g., closed-cell polypropylene or polyethylene), the expanded size differences normally translate directly into varying degrees of softness (e.g., ease of compression). The largest beads 66 are then softer (e.g., have a lower spring coefficient) and compress more easily than the medium-sized, denser beads 68 which in turn are softer and compress more easily than the smallest and densest beads 70. Consequently, in use when a force or blow 9 is applied as in FIG. 29, the beads 66, 68, and 70 will normally progressively compress from beads 66 (FIG. 30), to beads 68 (FIG. 31), to beads 70 (FIG. 32) to progressively absorb the blow. However, if the applied force or blow 9 is fairly light, it may be that only the largest beads 66 are compressed. Similarly, if the force 9 is an intermediate one, beads 66 and 68 may only be compressed. Heavy forces 9 would then progressively compress all of the beads 66, 68, and 70.

Regardless of the size of the impact force 9 and/or how many differently sized beads 66, 68, and 70 are compressed, the combined effect of the hard, outer shell 54 and relatively soft beads 66, 68, and 70 is at least two fold. First, it spreads out the applied force 9 and second, it extends or delays the transfer time of the applied force 9 through the padding 8' to the athlete's thigh 11. That is, the geometry of the hard shell 54 over the casings 20 in FIG. 29 will serve to spread out and dissipate the force 9 from the relatively small, impact area to the larger contact area between the casings 20 and the athlete's thigh 11. However, equally important in the overall design of the padding 8' of FIGS. 24–29 is the softness of the beads (whether or not a mix) in the casings 20. The beads in this regard are preferably soft enough that the initially reduced forces at 72 between the hard, outer shell 54 and beaded casings 20 in FIG. 29 will significantly compress the beads. Otherwise, the load of the impact force 9 will be transferred too quickly through the beaded casings 20 to the thigh 11 causing increased damage and injury (e.g., bruising). In contrast, the beaded casings 20 in the preferred embodiments of FIGS. 24–32 are as soft as possible to thereby be compressed by the forces 72 and extend the transfer time of the forces through the padding 8' as long as possible.

Figure 33:
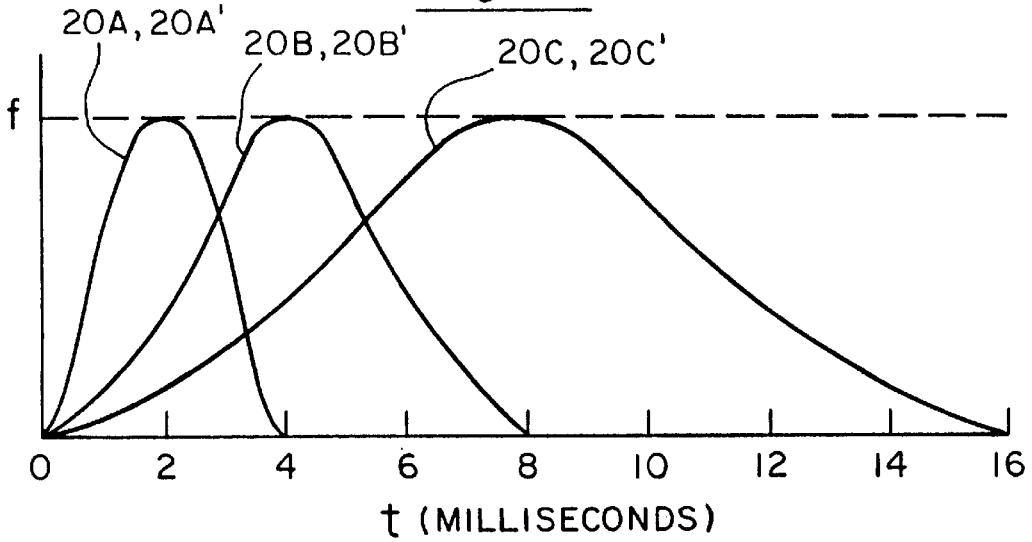
FIG. 33 schematically shows how softer beads and less filled casings delay the transfer time of the applied force to the athlete's body.

The empirical benefits of this extending or delaying of the transfer time of the forces through the padding 8' are to lessen the damage and injury to the athlete's body. This is schematically illustrated in FIG. 33. In this FIG. 33, the beaded casings are made progressively softer (e.g., more easily compressed) from casings 20A to 20B to 20C. Except for the softness of the beads, the beaded casings 20A, 20B, and 20C are otherwise identical. As shown, the transfer time t of the same, peak load or force f to the athlete's body for the softest, beaded casing 20C is essentially twice as long (e.g., 8 milliseconds) as for the less soft, beaded casing 20B (e.g., 4 milliseconds). Similarly, the least soft (i.e., hardest or firmest), beaded casing 20A has the quickest transfer time (e.g., 2 milliseconds) and is potentially the most damaging to the athlete. In making the beaded casing 20C as soft as possible, for example, the largest beads 66 in the mix would preferably be compressible with as little force as possible to 50% and preferably 20% of their relaxed or uncompressed volume. If made of the same material (e.g., polypropylene) as discussed above, the smaller beads 68 and 70 would not be as soft (e.g., would not be as easily compressed for any given force) but they still would preferably be very soft, easily compressible beads. Preferably, the beads are always made of a waterproof material (e.g., closed-cell foam of polypropylene or polyethylene).

FIG. 33 also schematically illustrates the benefit of underfilling the casings 20 (e.g., 80%–95% of a simple gravity fill). More specifically, FIG. 33 shows the force transfer delay for the thigh padding 8' configuration such as in FIG. 24 using an overfilled casing 20A', a gravity or 100% filled casing 20B', and an underfilled (e.g., 90% of a gravity filled) casing 20C'. Except for the degree of fill, the casings 20A', 20B', and 20C' in FIG. 33 are otherwise identical. The combined teachings of FIG. 33 is that in padding using a hard, outer shell 54, casings 20 that are underfilled (e.g., 90%) with the softest beads are preferred. This is not to say that overfilled casings 20 as in FIGS. 1–19 are not desirable when the protective padding has no hard, outer shell 54. In fact, such overfilled casings 20 are preferable over gravity filled or underfilled casings 20 if used alone without a hard, outer shell 54. However, when used with such a shell 54, overfilled casings 20 are less desirable than gravity filled ones which in turn are less desirable than slightly underfilled (e.g., 80%–95%) ones due primarily to the delayed transfer time effect discussed above.

Figure 29:
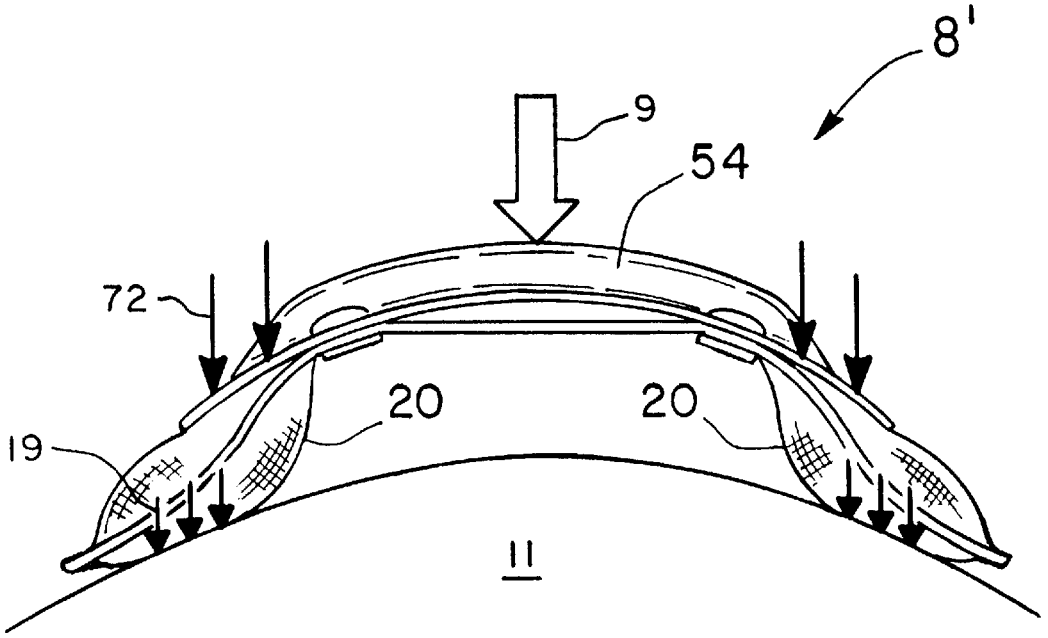
FIG. 29 is a view similar to FIG. 24 showing the result of the thigh padding of FIG. 24 receiving a blow or force.

In actual operation, the final stages of the transfer of the impact force 9 in FIG. 29 to the athlete's thigh 11 with an initially underfilled (e.g., 90%) casing 20 is essentially the same as discussed in regard to the overfilled casing 20 of FIGS. 9–11. The same is true for a gravity filled one. In other words, the underfilled or gravity filled casings 20 under a hard, outer shell 54 will distort to a smaller volume shape under the applied force 9 (compare the casings 20 of FIG. 24 to the more flattened ones of FIG. 29). This will essentially compress the beads 66, 68, and 70 and tension the inelastic casing 20 to thereafter operate in the manner of the initially overfilled casing 20 of FIGS. 1–23. However, as discussed above, the underfilled (and to a lesser extent the gravity filled) casings 20 will reach this state more slowly than an initially overfilled casing 20 (using the identical beads or bead mix).

Returning to the blending or mixing of bead sizes 66, 68, and 70 in FIG. 28, this offers several advantages. As discussed above, it creates a gradient of softnesses and a progression of bead compressions from the largest beads 66 down to the smallest beads 70. Additionally, and perhaps more importantly, such blending or mixing inhibits migration or movement of the beads relative to each other. This is true for overfilled, gravity filled, and underfilled casings 20 but is particularly important for underfilled ones. By blending the beads, the volume of the individual voids or interstitial spaces is reduced. This in turn inhibits bead migration by physically making it more difficult for the beads 66, 68, and 70 to move relative to each other as there simply is less space or room to do so. The volume of such voids or interstitial spaces might, for example, be reduced 10% to 25% by such mixing. The result is that adjacent beads within each pad casing 20 assume initial positions relative to each other after the casing 20 is initially filled and maintain their initial, relative positioning in use (i.e., the beads do not flow or migrate relative to each other). The beads in this regard essentially maintain or stay in the same, initial positions relative to each other and just vary their degree or amount of compression. This in turn helps to prevent the pad casings 20 from bottoming out in use. Such migration can also be inhibited by increasing the surface friction (e.g., roughness) of the beads (whether a mix or not) and by increasing the surface friction of the material of the outer casing 20 itself. The mesh size of the material of the outer casing 20 can also be varied so that portions of the beads actually protrude or stick through and become caught up in the mesh. Using stiffer material for the casings 20 will also help as will segmenting. Nevertheless, even without blending, it is noted that the beads will tend to clump, plug, or bridge against each other as illustrated in the lower left portion of FIG. 28. This not only inhibits migration of the beads but also helps create desirable voids in underfilled casings, as also best illustrated in the lower left portion of the underfilled casing 20 of FIG. 28.

Figure 34:
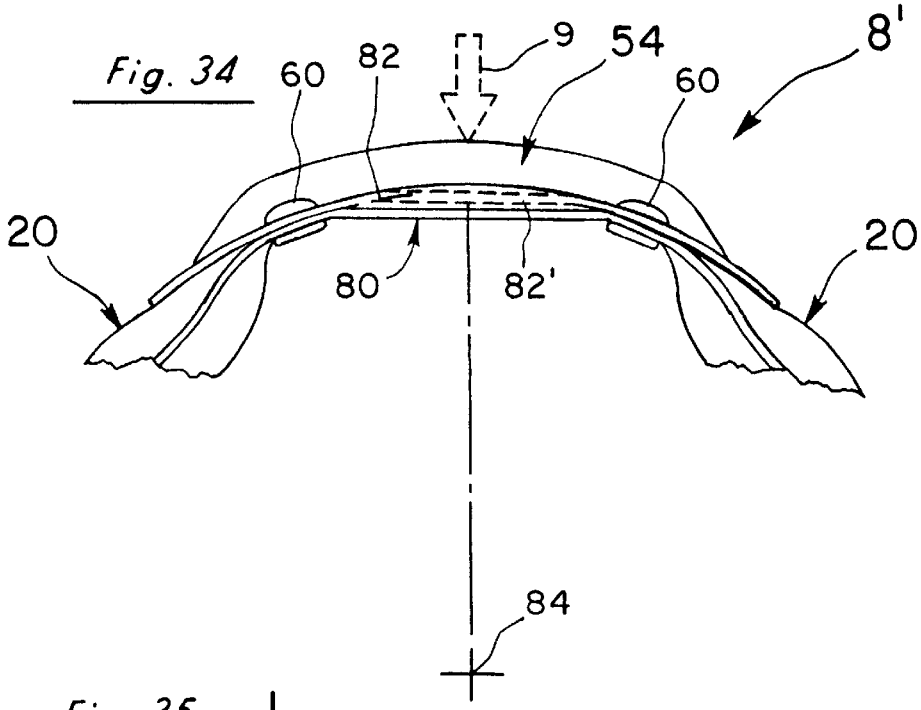
FIG. 34 is a view similar to FIG. 24 showing a reinforcing characteristic of the pontoon shape of the thigh padding.

FIG. 34 illustrates another aspect of the pontoon shape of the casings 20 of FIG. 24–25 in which the central portion 80 of the pontoon shape helps to reinforce the hard, outer shell 54. More specifically, the central portion 80 (i.e., the central portions or sides 30 and 32 of the flexible, inelastic material of casings 20 of FIG. 25) is attached at 60 to extend across the curved or arched, inner surface 82 of the hard shell 54 (see FIG. 24). The distance along the arched, concave, inner surface 82 about the axis 84 in FIG. 34 between the sections of the shell 54 at rivets 60 is then greater than the chord distance between the spaced-apart portions of 80 attached to the shell 54 at rivets 60. The chord-like portion 80 is preferably prestressed or pretensioned but can be simply taut if desired. Since the material of 80 is preferably inelastic and does not stretch, any force 9 applied in FIG. 34 tending to flatten the arch of surface 82 (e.g., toward the position 82' shown in dotted lines in FIG. 34) will be resisted by the piece of material 80. If desired, the portion 80 could be slightly loose if desired to then assume a taut or tightened condition upon any flattening movement of the arch at 82. Although preferably inelastic, the material of 80 could be elastic if desired and still act to reinforce the arched shape 82 of the shell 54.

Figure 35:
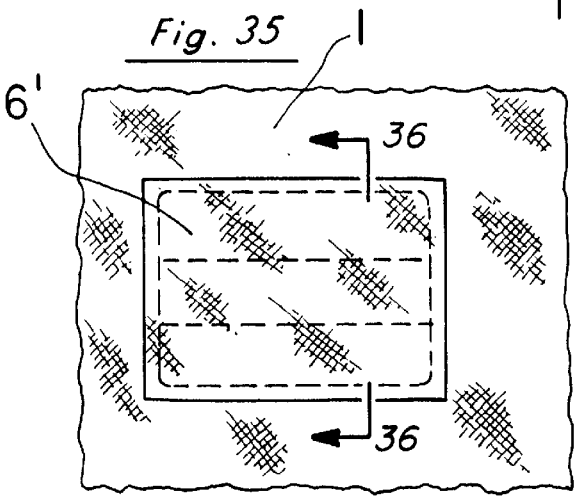
FIGS. 35–37 illustrate the application of features of the present invention to chest or sternum padding.
Figure 36:
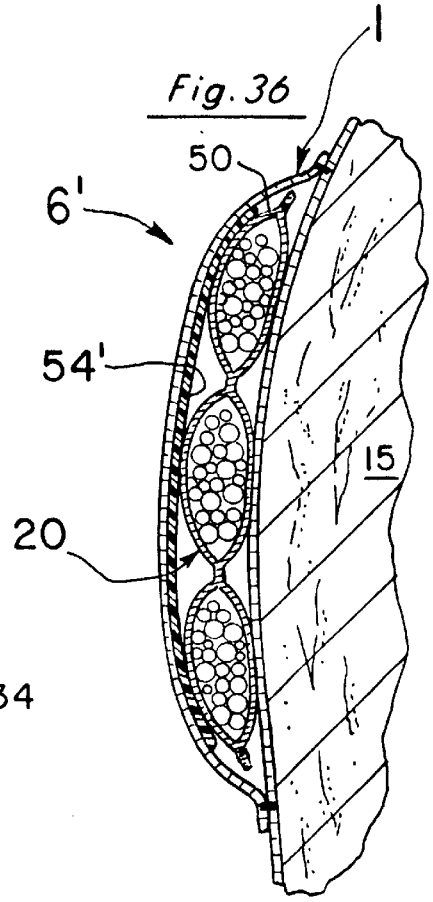
Figure 37:
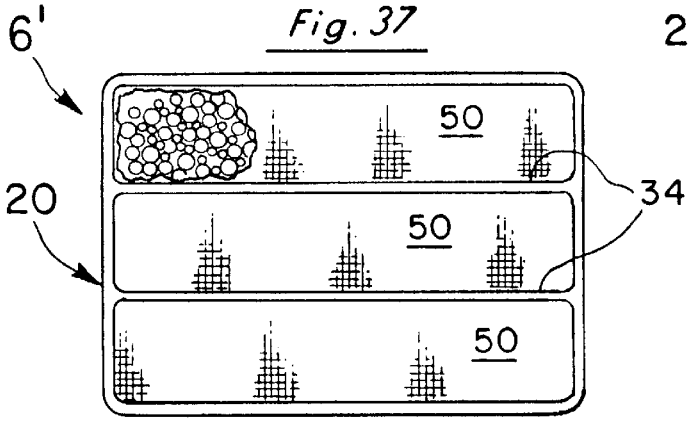

FIGS. 35–37 illustrate a modified chest or sternum padding 6'. In it, the padding 6' has a hard, outer shell 54' that is substantially flat or at least flatter than the shell 54 of FIG. 24. Additionally, casing 20 of FIGS. 35–37 is segmented at 34 (see FIGS. 36 and 37) to create multiple pouches 50. Each pouch 50 is preferably attached to the shell 54' as, for example, using rivets, hook and loop fasteners, or snaps. All of the pouches 50 are preferably underfilled as in FIG. 36 but could be gravity filled, overfilled, or a mix of the various degrees of filling. For example as shown in FIG. 37, the top pouch 50 could be underfilled, the middle pouch 50 gravity filled, and the bottom pouch 50 overfilled.

Figure 38:
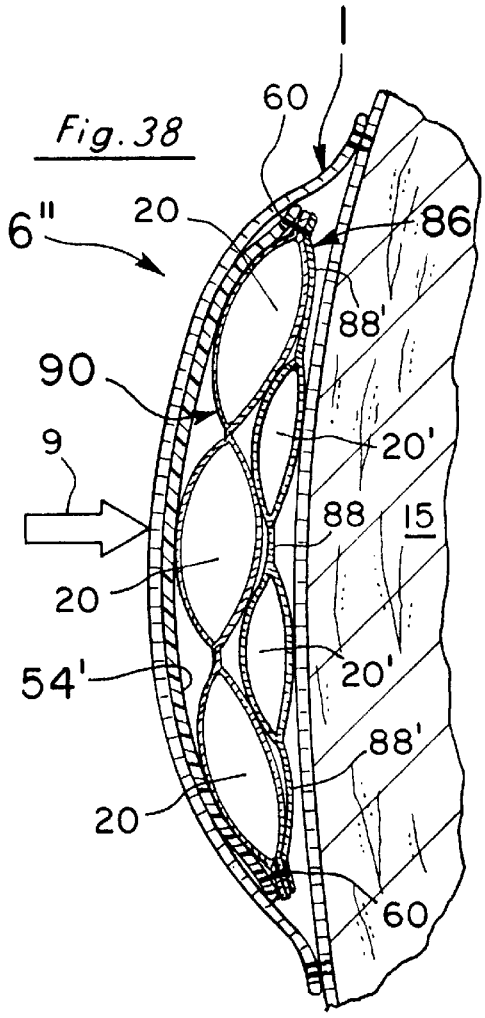
FIGS. 38–40 show further modifications to the basic structure of FIGS. 35–37.
Figure 39:
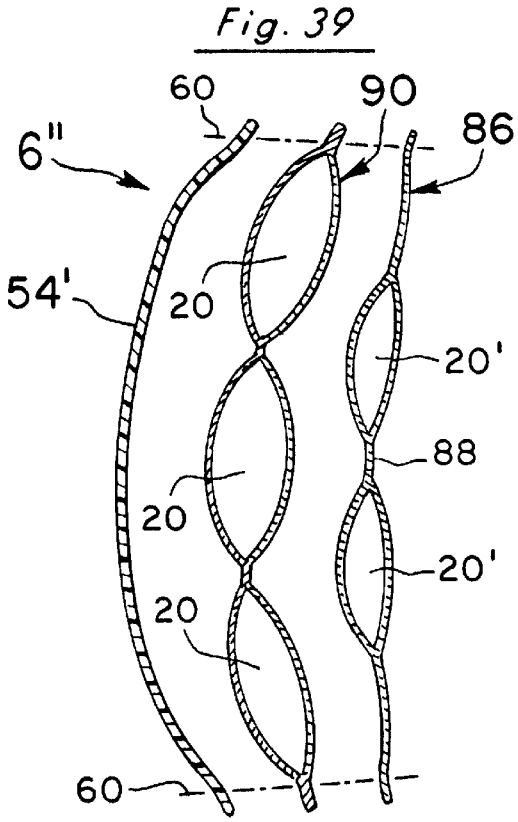
Figure 40:
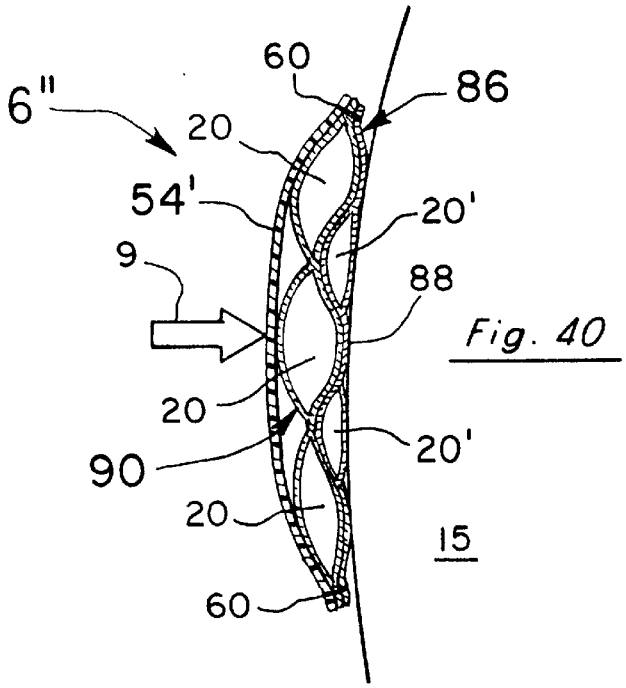

FIGS. 38–40 illustrate further modified padding 6" in which a pontoon-shaped, inner layer 86 (see FIG. 39) of beaded casings 20' with an interconnecting piece of material 88 is used with an overlying layer 90 of interconnected casings 20. The spaced-apart, pontoon casings 20' of layer 86 can be overfilled, gravity filled, or underfilled with beads. The layers 86 and 90 as shown are preferably attached at 60 (e.g., by stitching or rivets) to the hard, outer shell 54' with the respective casings 20' and 20 of the layers 86 and 90 staggered or nested relative to each other. In this manner, the layers 86 and 90 assume a relatively low profile. More importantly, the staggering positions the central pouch or casing 20 of layer 90 against the piece of material 88 extending between the pair of pontoon casings 20' of layer 86. The central casing 20 of layer 90 positioned against the connecting material 88 then essentially forms a triangle with the pair of pontoon casings 20' (see FIG. 38). Consequently, in use when a force 9 is applied as in FIG. 38, the force 9 will press the central casing 20 of the outer layer 90 against the piece of material 88 connecting the pontoon casings 20'. This in turn will transfer and spread out (dissipate) the force to the pontoon casings 20' somewhat in the manner of FIG. 29. As best seen in FIG. 40, the result of the layering and pontoon structure is that essentially all of the beaded casings 20' and 20 of both layers 86 and 90 are flattened and compressed against the athlete's body 15. To improve the flattening and increase the contact, surface area against the athlete's body 15, the pontoon casings 20' are preferably smaller than the casings 20 of the outer layer 90. The force or impact 9 is then not only greatly dissipated but also the transfer time through the pad 6" is significantly increased (e.g., by 1–2 milliseconds). The material 88 is preferably elastic to better accommodate the movement and flattening of the casings 20' and 20 of both layers 86 and 90 against the athlete's body 15. As shown, the upper and lower casings 20 of the outer layer 90 of FIG. 38 are also suspended in a similar manner by the pieces 88' of elastic material extending respectively between each of the attachments 60 and one of the pontoon casings 20'. In a similar but less effective way, forces applied to these upper and lower casings 20 of layer 90 are also transferred and dissipated through the immediately adjacent pontoon casing 20'.

FIGS. 41 and 42 show a doughnut-shaped pad 92. The pad 92 is segmented at 34 wherein the filling degree of the various, beaded pouches 50 could be varied as desired in a manner similar to the padding 6' of FIG. 37. In one application of the pad 92 of FIG. 41 to protect, for example, the top of a shoulder and clavicle, the central pouch 50 might be underfilled or at least filled to a lesser degree than the surrounding pouches 50 (which could be overfilled, gravity filled, or underfilled). The pad 92 of FIGS. 41–42 as well as the one of FIGS. 43–44 discussed below could be used with or without a hard, covering shell 54.

The pad 96 of FIG. 43 has an initially gravity filled or underfilled casing 20 attached to a stretchable band 98 such as would be applicable for use as an elbow, knee, or arm pad. In use, the stretchable, elastic band 98 will actually distort and constrict or reduce the volume of the casing 20 (compare FIGS. 43 and 44). The initially gravity filled or underfilled casing 20 of FIG. 43 will then assume the overfilled condition of the first set of protective padding of FIGS. 1–23 and act in the same manner. FIGS. 43 and 44 thus illustrate a method for creating an overfilled pad from an initially underfilled or gravity filled one. In doing so, the initially underfilled or gravity filled casing 20 is pressed against (stretched about) the user's body (i.e., arm 17 in FIG. 44) until the volume of the casing 20 is distorted or reduced to create an overfilled condition. The inelastic casing 20 is then under tension and substantially all of the beads are in compression. If the casing material is elastic, then the distortion preferably stretches the casing material to its elastic limit. Either way, the mere placing of the pad 96 on the athlete's arm 17 overfills the casing 20 and places it in condition to receive a blow in the manner of FIGS. 9–11. The pad 96 is preferably not used in combination with a hard, outer shell 54 but could be if desired.

In the embodiment of FIGS. 45–46, the beads 22 (whether a blend of beads 66, 68, and 70 or not) are fused together wherein the pad itself assumes a predetermined shape. The beads are preferably a mix so that the characteristics of the overall pad, including softness and transfer time (attenuation) of the force through it, can be varied as desired. The fusing can be done, for example, by lightly steaming or gluing the beads. The shaping could be done by simply fusing the beads within a mold to create the desired shape or the desired shape could be achieved by first fusing the beads into boards or other bulk forms that were then cut to the desired shape. The fused beads could be used with or without an outer casing 20. When an outer casing 20 is used, it would preferably be attached about the beads either prior to or during the fusing process but could be done afterward. The fit of the casing 20 about the beads could be loose or snug but preferably would place the casing 20 in tension as, for example, by a shrink-wrapping process (e.g., heat up the polypropylene casing 20). This would also place the beads in a slight compression. The resulting pad 12' could then be used, for example, in the helmet 5 of FIG. 1 and removably attached in place to the hard shell of the helmet 5 using hook and loop fasteners (e.g., Velcro) 100 or snaps or more permanently attached with rivets if desired. The pad 12' could be nominally fashioned in progressive sizes to fit the contours of the athlete's head 19 or custom fused and shaped to the particular athlete exact shape. The casing 20 in this regard helps the pad 12' to maintain its integrity, particularly if the casing 20 is shrink-wrapped in place or otherwise attached to the beads (e.g., by glue). Further, should the pad 12' become fractured, the casing 20 helps to hold the pieces together. The casing 20 is preferably a very porous and breathable mesh and the beads are preferably made of lightweight, closed-cell foam. Even though adjacent, abutting portions of the fused beads are joined to each other, there still is a significant amount of interstitial spaces between the beads. The result is then a waterproof yet highly porous and breathable pad 12' that can be pre-shaped as desired. Like all the other, preferred pads and padding of the present invention, the pad 12' itself, does not absorb water or odors, is relatively cool to wear, and can be easily washed.

Figure 47:
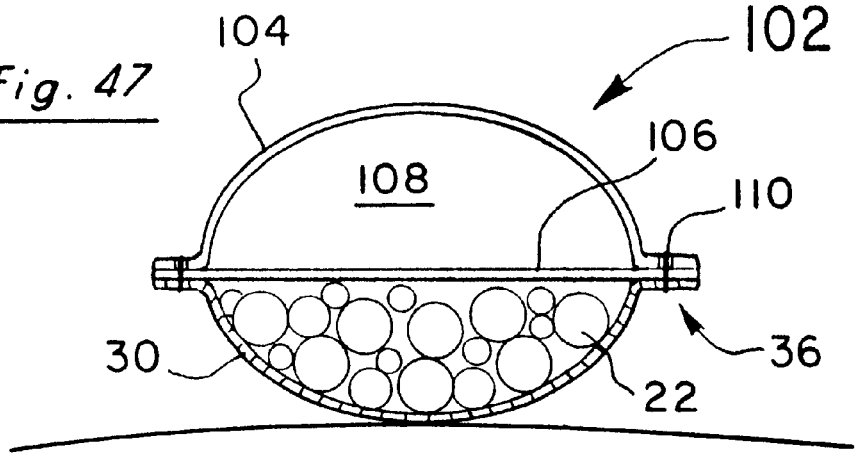
FIGS. 47–48 illustrate a modified pad in which the upper half is a waterproof and airtight compartment filled with open-cell foam and the lower half is a porous compartment filled with closed-cell, foam beads.
Figure 48:
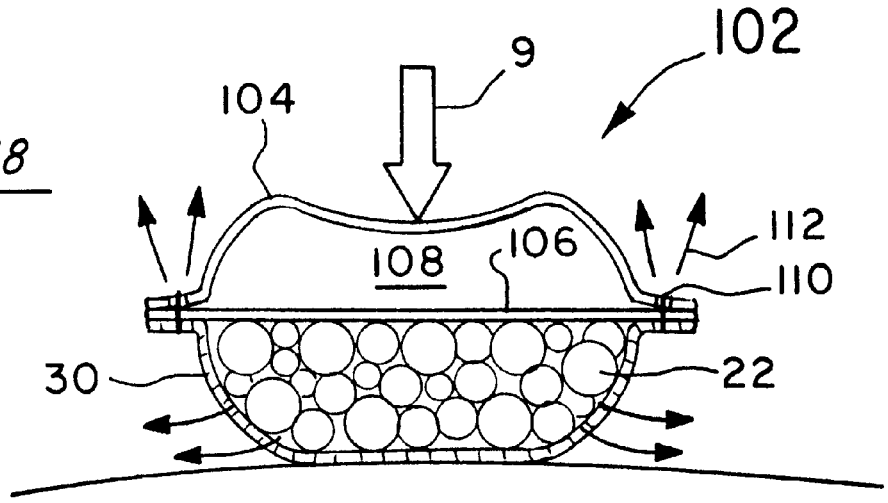

In the embodiment of FIGS. 47–48, a modified casing 102 is used which has a substantially waterproof and airtight upper portion 104 and a flexible, porous, breathable, lower portion 30 as in prior embodiments. Separating the two portions is an intermediate portion or layer 106 of the same material as portion 104. The upper half or compartment formed by portions 104 and 106 of the casing 102 is filled with a layer of open-celled foam 108 (e.g., urethane) and the lower half or compartment bounded by portions 30 and 106 is filled as in the prior embodiments with closed-cell, foam beads 22 (e.g., polypropylene). The boundaries at 36 of the portions 104, 106, and 30 are preferably sewn together at 110. In use when a blow or force 9 is applied as in FIG. 48, the upper half of the casing 102 is depressed under the force of the blow 9 to compress the open-celled foam 108 as well as the beads 22 in the lower half of the casing 20. The air from the open-cell foam 108 in the upper half of the casing 102 is expelled at 112 primarily through the holes about the stitches 110. Depending upon the characteristics of the sewing (e.g., spacing or number of stitches 110 per inch, the size of the stitch holes relative to the size of the stitches 110 themselves, the degree the pad is heated to vary the size of the stitch holes, the porosity of the material of the stitches 110, and the degree to which portions 104 and 106 are pressed or sealed together between the stitches 110), the rate of the escaping air 112 can be varied as desired. This in turn will give the overall pad varying degrees of softness and transfer time. The material of portion 104 in this regard is preferably waterproof and airtight (e.g., treated nylon) but could be waterproof and slightly porous to air if desired. The degree of air porosity through the material of 104 could then be varied to further modify the rate of the escaping air without adversely affecting the waterproofness of the upper compartment. The foam 108 in the upper half within portion 104 is preferably slightly compressed in the initial condition of FIG. 48. The beads in the lower half within portion 30 in FIG. 48 can be a mix if desired and this lower half of the casing 102 can be initially overfilled, gravity filled, or underfilled depending upon the particular application. In the preferred embodiment, the upper and lower halves or compartments of the casing 102 initially are filled to have substantially semi-circular cross sections as illustrated in FIG. 48. As with the other embodiments, the pad of FIGS. 47–48 could be used with a hard, outer shell if desired.

FIGS. 49–58 illustrate the basic bead padding of the present invention adapted into an articulated pad 21 for protecting joints such as knees 13 and elbows. Such joints present special problems as they need to have both their central, protruding, bony prominence (e.g., kneecap 131 in FIG. 50) protected as well as their side portions (13" in FIG. 50). Yet, the joint articulates or moves and if the protecting pad is not articulated, it cannot follow the joint's movement and cannot continually protect both the joint's body prominence 13' and its side portions 13". In most cases, pads for such joints are simply an encircling, elastic band with a central pad over the bony prominence. The band and pad stretch and contract in an effort to follow and accommodate the movement of the joint and to maintain the central pad over the bony prominence (e.g., kneecap 13' or elbow). However, such bands tend to unduly restrict the athlete's movement and normally offer no protection to the sides 13" of the joint 13. With this in mind, the articulated pad 21 of FIGS. 49–58 was developed. The pad 21 offers all of the previously discussed advantages of the beaded padding of the present invention. Further, it does so in a pad that protects not only the bony prominence 13' of the joint 13 but also the sides 13" of the joint 13 while offering minimal resistance to the athlete's movements.

Figure 49:
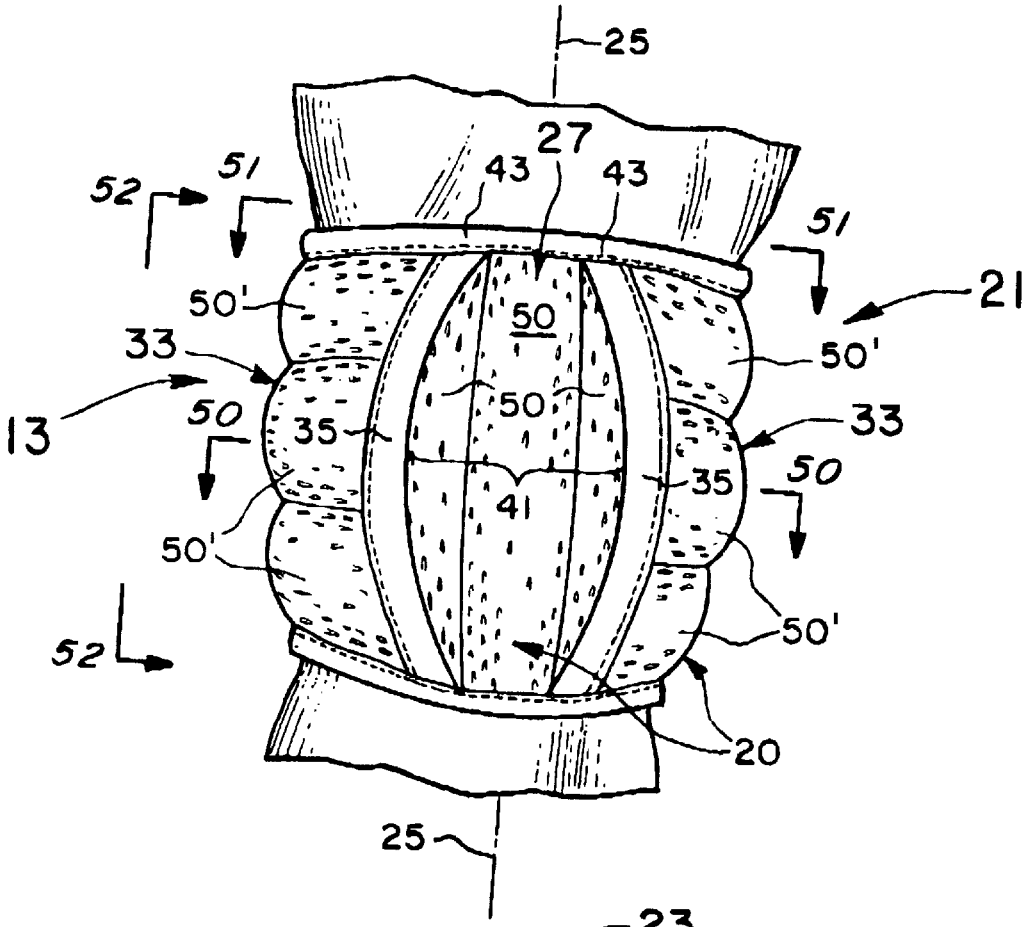
FIG. 49 illustrates an adaptation of the present invention into an articulated pad for joints such as knees and elbows.
Figure 50:
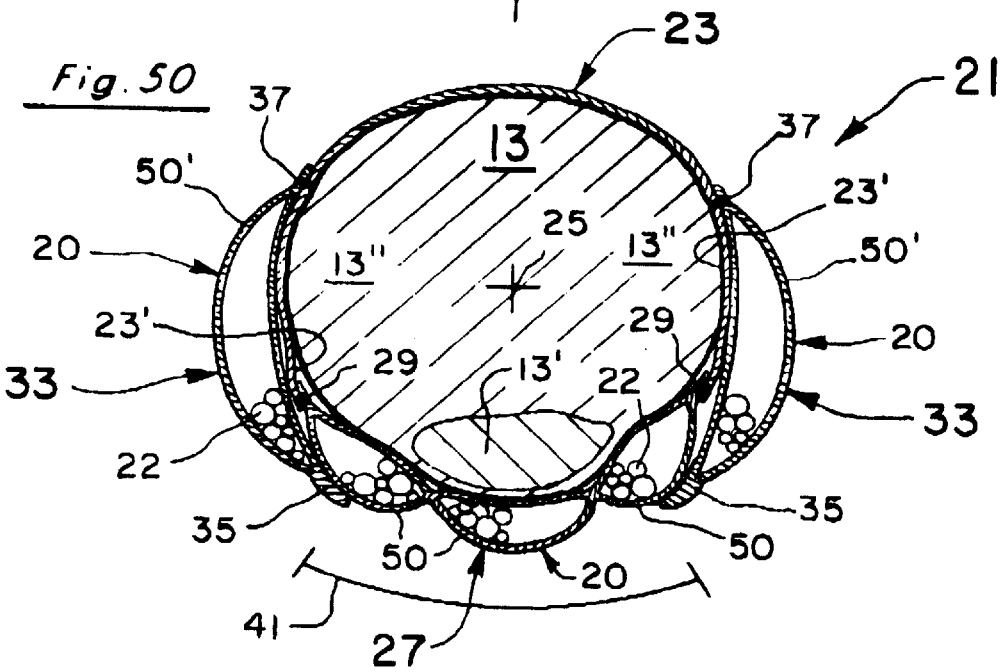
FIG. 50 is a cross-sectional view taken along line 50—50 of FIG. 49.
Figure 51:
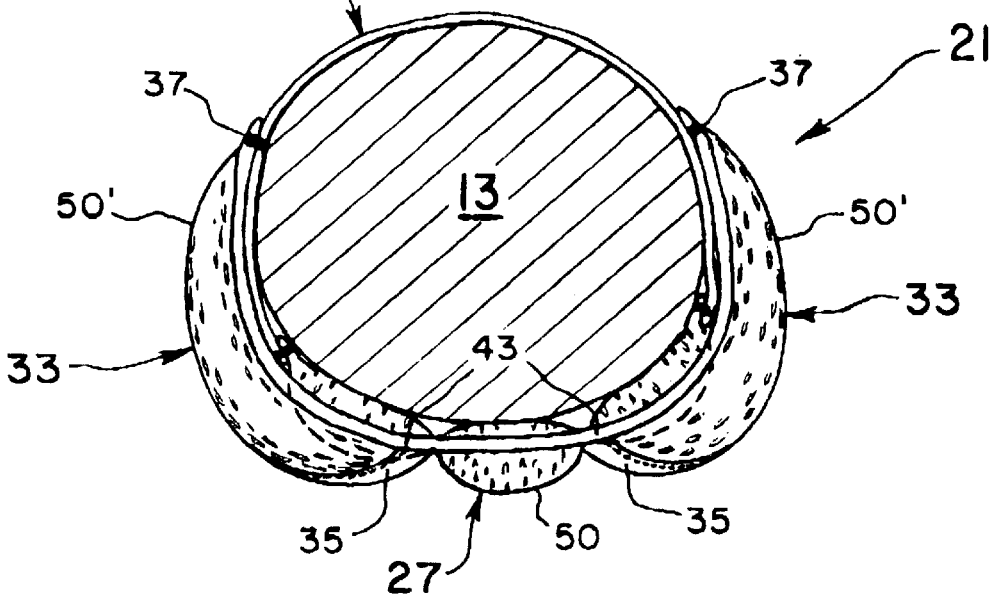
FIG. 51 is a cross-sectional view taken along line 51—51 of FIG. 49.
Figure 52:
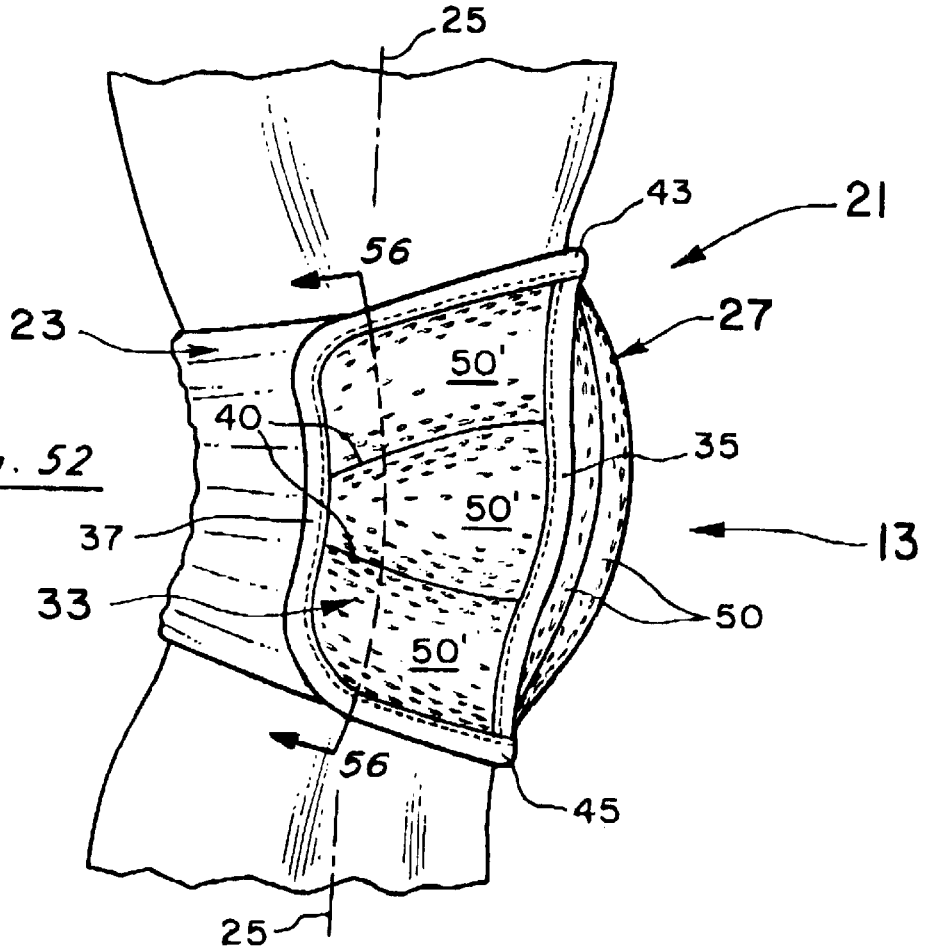
FIG. 52 is a side view taken along line 52—52 of FIG. 49.

More specifically and referring to FIGS. 49 and 50, the articulated pad 21 includes a rear, elastic band 23 (see FIG. 50) extending along and partially about the axis 25. In the preferred embodiment, a central padded portion 27 also extends along and partially about the axis 25 in the front of the pad 21. The central padded portion 27 as shown is attached at the side sections 29 thereof (see FIG. 50) to the end sections of segments 23' of the elastic band 23. This central padded portion 27 preferably includes a casing 20 as in earlier embodiments with three pouches 50 containing resilient, discrete beads 22. The beads 22 if desired can be a mix of sizes and/or shapes as in earlier embodiments and are preferably made of substantially waterproof, elastic material (e.g., closed-cell, polypropylene foam). For clarity, only a few or no beads 22 are shown in the illustrated casings 20 and pouches 50. The pouches 50 can be filled with beads 22 to varying degrees (e.g., overfilled, gravity filled, or underfilled) but preferably are overfilled wherein substantially all of the beads 22 are in compression. The material of casing 20 is preferably inelastic and waterproof as in earlier embodiments with each pouch 50 of the casing 20 of pad 27 overfilled so as to be slightly tensioned. If the casing material is slightly elastic as in earlier embodiments, each pouch 50 of the casing 20 is preferably overfilled to the elastic limit of the material so the casing material does not stretch in use. The central padded portion 27 is then positioned as in FIG. 50 over the bony prominence (e.g., kneecap 13') of the joint 13.

The articulated pad 21 of FIGS. 49 and 50 also include two, padded side portions 33, positionable over the side portions 13" of the knee 13 in FIG. 50. Each side portion 33 has front 35 and rear 37 sections with the rear sections 37 being attached (see FIG. 50) to the elastic band 23. The front sections 35 of the side portions 33 as seen in FIGS. 49 and 50 are spaced apart from each other to define or form an opening 41. The underlying, central padded portion 27 is then at least partially positioned or received in the opening 41. Each front section 35 at upper and lower locations 43 and 45 is joined and attached (e.g., sewn) to the central padded portion 27 (see FIGS. 49 and 51).

In this manner as explained in more detail below, the front sections 35 (between the attached locations 43 and 45) are allowed to open or move about the axis 25 in FIGS. 49 and 50 relative to each other and to the central padded section 27. The articulated pad 21 as also discussed below can then accommodate the movement of the joint 13 while still protecting the bony prominence (e.g., kneecap 13') with the central pad 27 and protecting the side portions 13" of the joint 13 with the side pads 33. Further, the articulated pad 21 does so with little restriction to the athlete's movement. Since the casings 20 of pads 27 and 33 like earlier embodiments are very porous and breathable and the beads 22 are very lightweight and have significant interstitial spaces, the entire pad 21 is equally very porous, breathable, lightweight, and cool. As previously mentioned and although each casing is a porous mesh, the casing material itself (e.g., polypropylene) is waterproof as is the bead material itself (e.g., closed-cell foam). Consequently, the entire pad 21 is completely washable and will not retain or absorb water or other moisture. More importantly, air and liquids can then readily pass through the assembled pad 21 in use.

In such use and referring first to FIGS. 49 and 50 with the articulated pad 21 on the relatively straight joint 13, the central padded portion 27 is positioned over the kneecap 13' and the padded side portions 33 are over the sides 13" of the knee 13. The opening or iris slit 41 between the front sections 35 is relatively small and essentially only the central pouch 50 of pad 27 protrudes through the opening 41. However, as the athlete flexes the knee 13 from FIG. 52 to FIG. 53, the front sections 35 of the side pads 33 are pulled apart (see FIG. 54). This flexing widens the opening 41 between sections 35. It also exposes more of the central pad 27 (see FIG. 54) yet the side pads 33 remain over the side portions 13" of the knee 13 as shown in FIG. 55. This action can also be seen by comparing FIGS. 50 and 55 wherein the front sections 35 of the side pads 33 slide over the two, outside pouches 50 of the front pad 27 much like a cat's iris opening up. The extended joint 13 in FIG. 55 may slightly increase the curvature of the three pouches 59 of the pad 27 but the pad 27 does not move from the protective position over the kneecap 13'. The side pads 33 in contrast are free to move relative to each other and to the central pad 27 to accommodate the joint's extension yet maintain the side pads 33 over the sides 13" of the knee 13.

In the preferred embodiment of the articulated pad 21, the central pad 27 has a plurality of pouches 50 joined at seams 34 (see FIGS. 54 and 55). These seams 34 as illustrated run or extend along the axis 25. Among other reasons, this is preferred because most sliding or glancing blows from the front and sliding contact with the ground against the kneecap 13' area are directed along the axis 25. The blows and contact will then easily move along the pad 27 over the pouches 50. If the joining seams 34 were horizontal, then such sliding blows and contact from the front and directed along the axis 25 would have more of a tendency to hang up or catch in the convolutions or seams of the pad 27. The vertical seams 34 of pad 27 also permit the central padded portion 27 to better flex and conform to the joint 13 about the axis 25 as shown in FIGS. 50 and 55.

For similar reasons, the padded side portions 33 have pouches 50' joined by seams 40 (see FIGS. 52 and 54) extending substantially horizontally or perpendicularly to the axis 25. In this regard, most sliding or glancing blows from the side and sliding contact with the ground against the sides 13" of the knee 13 would then more easily pass over the pouches 50' of the side pads 33. The horizontal alignment of the seams 40 of the side pads 33 also better accommodates the bending movement of the joint 13 wherein the vertically stacked pouches 50' in FIGS. 56 and 57 can more easily move together (e.g., from FIG. 56 to FIG. 57) and apart in an accordion-like manner. This is even true to some degree along the horizontal seams 40. That is, the movement of the joint 13 from FIG. 52 to FIG. 53 and correspondingly from FIG. 56 to FIG. 57 will compress the pouches 50' toward the back of the knee 13 (FIGS. 53 and 57) while at the same time relax or flatten the pouches 50' (FIG. 53) somewhat toward the front of the knee 13 along 35. Additionally, the perpendicular alignment of the seams 34 and 40 and pouches 50 and 50' of pads 27 and 33 also facilitates the sliding motion of the side pads 33 over the underlying parts (i.e., the two, outside pouches 50) of the central pad 27 (see FIGS. 50 and 55).

It is also noted in this general regard that in the position of FIGS. 49 and 50 with the joint 13 straight, each front portion of each side pad 33 (see FIGS. 49 and 50) overlaps an underlying, outer pouch 50 of the central pad 27. Consequently, any glancing blow or impact somewhat from the side in this position will be absorbed by both the front portion of the side pad 33 and the underlying pouch 50. The outer pouches 50 of pad 27 in this position are thus overlapped as in FIG. 50 by the front portion of each side pad 33 and provide additional protection.

In the further embodiment of FIG. 58, the central pad 27 of the articulated pad 21' is attached to the side pads 33 as in FIGS. 49–57 at locations 43 and 45. However, the central pad 27 in this further embodiment of FIG. 58 is not attached to the elastic band 23 as in the preferred embodiment of FIGS. 49–57 (i.e., there are no segments 23' of band 23). Consequently, the pad 27 in FIG. 58 is attached at front locations 43 and 45 to the side pads 33 as in the embodiment of FIGS. 49–57 and the side pads 33 of FIG. 58 are then attached at 37 to the elastic band 23. Nevertheless, this further embodiment of FIG. 58 offers significant, articulated protection to the joint 13 including its bony prominence 13' and sides 13". The elastic segments 23' removed in FIG. 58 essentially eliminate any horizontal forces tending to draw out or flatten the three pouches 50 of central pad 27 as the athlete flexes the knee joint 13. Maximum protection is thus provided at all times over the kneecap 13'. In the preferred embodiment of FIGS. 49–57, the elastic segments 23' are added for integrity to help keep the pouches 50 of pad 27 against the front of the knee 13. In this regard, the elasticity of the segment 23' in the embodiment of FIGS. 49–57 is preferably not strong enough to significantly pull or flatten the pouches 50 of pad 27 in use. Further, even with the band 23 (including segments 23') made of the same piece of material, most of the force of the flexing joint is taken up by pulling the inelastic casings 20 of the side pads 33 rearwardly as in FIG. 55. It is further noted that the pouches 50 and 50' of padding 27 and 33 are preferably overfilled but can be gravity filled or underfilled if desired.

FIGS. 59 and 60 illustrate a bridging technique using the beaded padding of the present invention. In this technique, a void or space 61 in FIG. 59 is preferably created over a particularly vulnerable body part (e.g., the end 63 of the clavicle at the shoulder or even over a normally healthy body part that has been damaged). The bridging structure is similar to the pontoon shape of the embodiment of FIGS. 24–29 and 34 but preferably uses overfilled casings 20(*b*) on each pontoon (FIG. 59). The bridging structure also adds an additional, smaller, overfilled casing 20(*m*) in the middle as in FIG. 59. As in earlier illustrations and for clarity, only a few or no beads 22 are shown in the illustrated casings.

This embodiment of FIG. 59 is intended to keep a relatively low, vertical profile. It also anticipates that a severe blow such as 9 in FIG. 60 may slightly flatten the hard, outer shell 54 but in any event will most likely bring the middle pad 20(*m*) into contact with the athlete's body over the vulnerable body part (e.g., clavicle 63 in FIG. 60). However, before doing so, the bulk of the force of blow 9 will have been transferred and absorbed at 19 by the athlete's body at the pontoon casings 20(*b*). The impact 19' at the protected clavicle 63 will then be greatly minimized. The pontoon casings 20(*b*) in this regard are much thicker than the middle casing 20(*m*) (e.g., twice as thick or more) giving the casings 20(*b*) and 20(*m*) an overall bridge-like or arch-like shape and operation. That is, the pontoon casings or padded members 20(*b*) as shown are spaced apart from each other about the curved, inner surface 82 of the shell 54. The middle casing or padded member 20(*m*) is then positioned between the outer casings 20(*b*) to span the casings 20(*b*). The casings 20(*b*) and 20(*m*) are preferably joined to each other at the seams as in earlier embodiments. Additionally, the casings 20(*b*) and 20(*m*) are mounted or attached by rivets or stitching at 60 to the hard, outer shell 54 with the casings 20(*b*) adjacent spaced-apart sections of the curved, inner surface 82 and the middle casing 20(*m*) therebetween.

In the preferred embodiments of FIGS. 61 and 61, each pontoon end or padded member is a stack of two, overfilled casings. In the embodiment of FIG. 61, the stacked casings 20(*s*) are substantially the same size as each other and the middle casing 20(*m*). In the embodiment, of FIG. 62, the lower casing or padded member 20(*b*) in each stack is thicker or bigger than the smaller, upper casing 20(*s*) (e.g., twice as thick or more). In use, it has been found that the stacked casings of FIGS. 61 and 62 increase the transfer time t of FIG. 33 as compared to a single casing 20(*b*) as in FIGS. 59 and 60. This in turn reduces or delays the transfer of the force 19 to the athlete's body and reduces the damage to the athlete's body. It is believed the inclusion of multiple layers of casings (each casing layer preferably being made of substantially inelastic material or slightly elastic material stretched to its elastic limit) results in this increased transfer time t. That is, it is believed the stacked casings of FIGS. 61 and 62 cause the basic force transfer of FIGS. 9–11 to be repeated twice, further delaying the transfer to the athlete's body.

It is also noted at this time that earlier embodiments as a general rule preferred gravity filled or underfilled casings 20 when used under a hard, outer shell such as 54 (as particularly discussed in regard to FIG. 33). However, the discussions relating to FIG. 33 and to the prior embodiment of FIGS. 21–22 also reveal that overfilled casings can be effectively used under hard, outer shells when the beads 22 are very soft as in the preferred bridge embodiments of FIGS. 59–62. Further, in these bridge embodiments, the pads have been specially adapted to cover and protect particularly vulnerable body parts. Consequently, to best maintain the integrity and positioning of the beads 22 relative to each other in each casing to virtually eliminate any bead migration and possibility of bottoming out, the casings are all preferably overfilled. Being overfilled with substantially all of the beads 22 in compression (or at least substantially all of the largest beads in compression if a mix) , there is a relatively higher probability that the force transfer and distribution will be as shown in FIG. 60 and the particularly vulnerable body part (e.g., clavicle 63) will be best protected.

The casing 20(*m*) of the middle span in FIGS. 59–62 as mentioned above is preferably made of inelastic material (or slightly elastic material stretched to its elastic limit) . In operation to absorb a blow 9 as in FIG. 60, the material itself of the middle casing 20(*m*) preferably does not stretch but the beads 22 within the casing 20(*m*) are compressed and the casing 20(*m*) may be slightly flattened or extended. The inelastic nature of the middle casing 20(*m*) to a certain degree then acts like the inelastic member 80 of FIGS. 24 and 34 to reinforce the curved shell 54. However, as compared to the embodiment of FIG. 24, beaded padding is added in FIGS. 59–62 between the casing layers 30 and 32 of member 80 in FIG. 24.

Figures 63, 64:
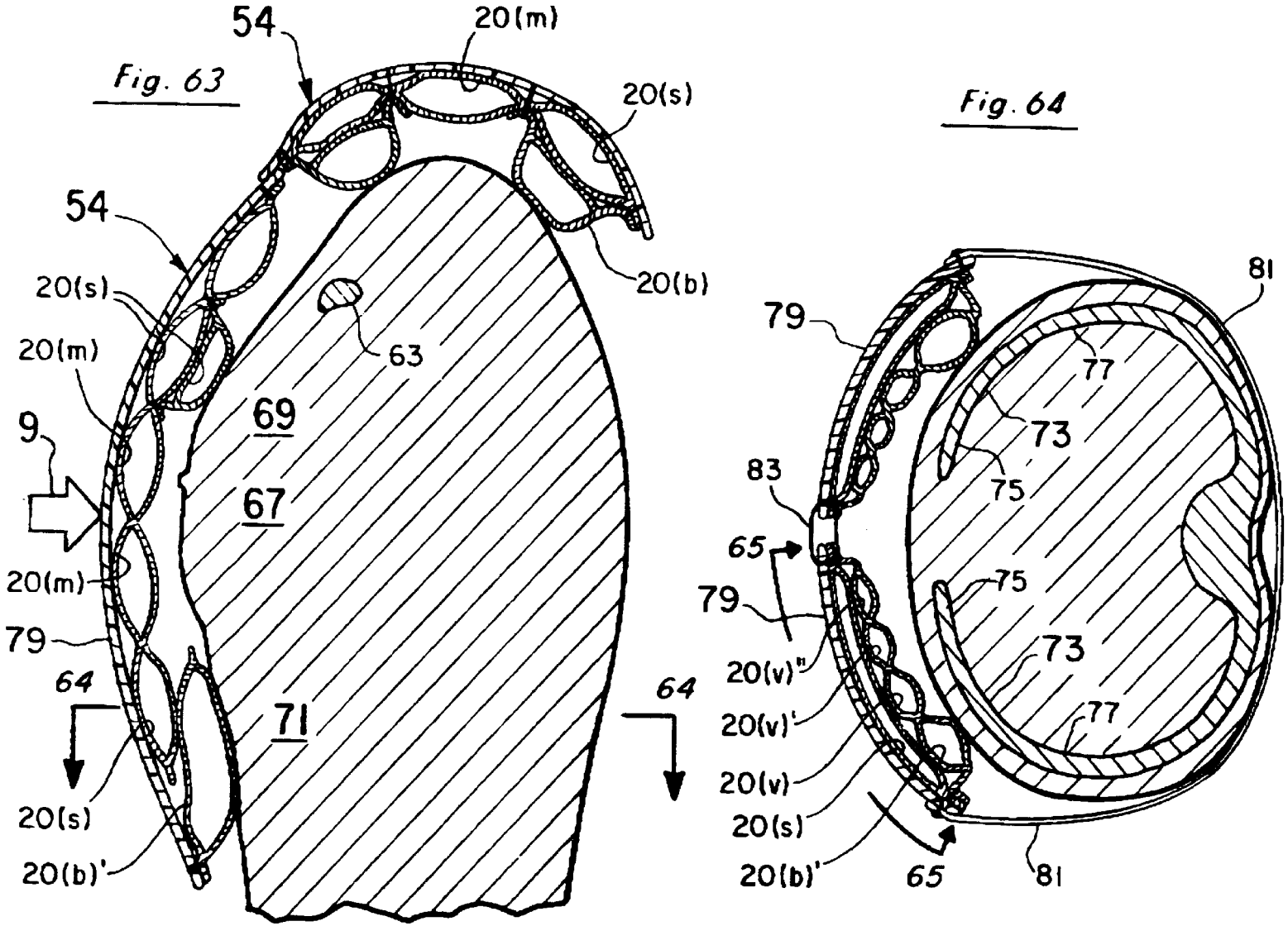
FIG. 63 illustrates the basic bridging concept of FIGS. 59–62 adapted to protect larger areas of the user's body.
FIG. 64 is a view taken along line 64—64 of FIG. 63.

The basic bridge structure of FIGS. 59–62 can also be expanded to extend over larger body areas as in FIG. 63. In FIG. 63, the particularly vulnerable body parts to be protected are the clavicle 63 above the nipple and the chest area 67 roughly at the nipple and heart level. In the chest area 67, any blow 9 to the shell 54 is then transferred by the bridging structure to the pectoral muscle 69 above the vulnerable area 67 and to the lower rib area 71 below area 67. FIG. 63 also illustrates other variations of the basic bridge structure in which two, middle casings 20(*m*) over the chest area 67 are used to span the pontoons. Additionally, the pontoons in this area are respectively a stack of two, smaller casings 20(*s*) on one side above area 67 in FIG. 63 and a stack of a small casing 20(*s*) and a larger casing 20(*b*)' on the lower side of area 67 at the rib area 71. In this manner, the overall padding can essentially be tailored to the athlete's body and needs. In the disclosed embodiments using shells such as 54 and 54', the shells may have different cross-sectional shapes as shown but are essentially the same (e.g., hard, perforated, outer shells). They also operate essentially the same to initially distribute or spread out any applied force to the underlying, padded members or casings.

In further reference to FIG. 63 and protecting the athlete's lower rib area 71, the athlete's ribcage and ribs 73 in FIG. 64 are particularly vulnerable at the front or center 75 of the ribs 73. That is, the ribcage is much better able to withstand forces the farther the forces are applied against the athlete's body toward the rear at 77 away from the front or center area 75 of the ribs 73. Consequently, it is desirable to bridge from side-to-side over the front or center areas 75 of the ribcage as in FIG. 64, It is even more desirable to actually taper the middle span area of the bridge as indicated by the decreasingly smaller or thinner casings 20(*b*)', 20(*v*), 20(*v*)', and 20(*v*)" in FIG. 64. In most cases, the pad of FIG. 64 will have two, distinct and essentially cantilevered or suspended portions 79 held in place in part by back strap 81 and front ties 83. Front ties 83 in this regard help support and allow the portions 79 to move slightly relative to each other to accommodate movements of the athlete's body. As shown in FIG. 64, the tapered or progressive middle span area will first cause a blow to be transferred at the outer casing 20(*b*)' to the athlete's body and then progressively inward from casing 20(*v*) to 20(*v*)' to 20(*v*)". Ideally, most blows would be transferred to the outer casing or casings 20 (*b*)' and only the most severe of blows would be absorbed against the athlete's body by casings 20(*v*)".

Figure 65:
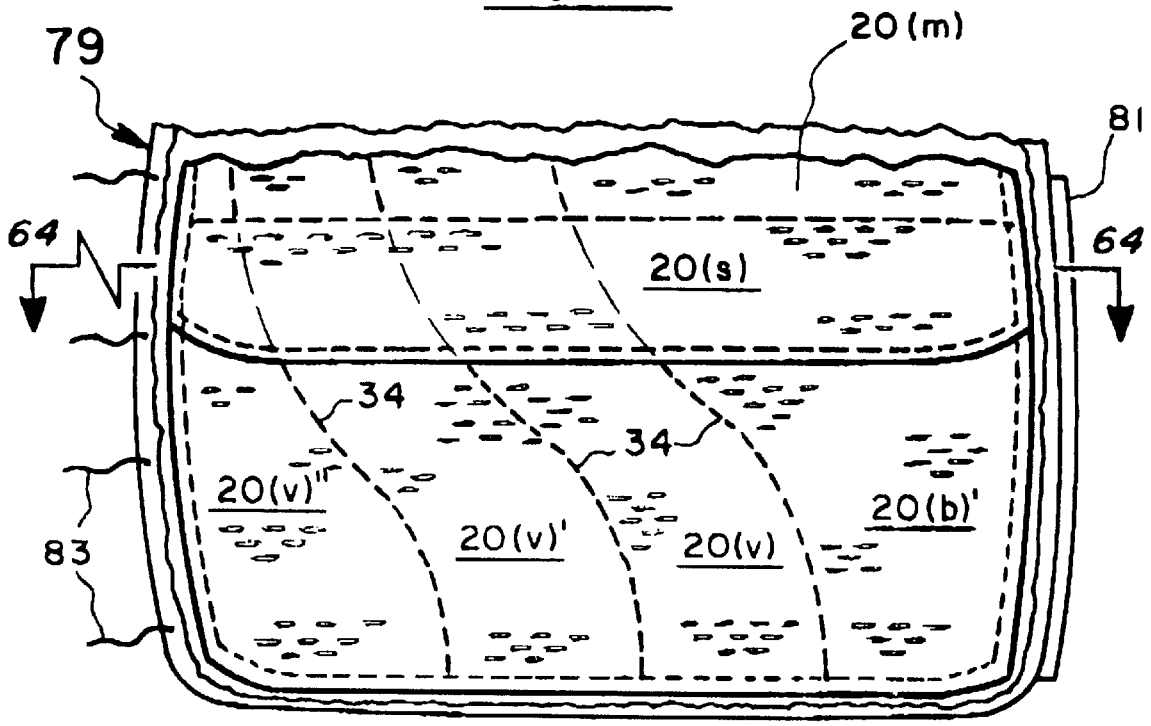
FIG. 65 is a view taken along line 65—65 of FIG. 64.

FIG. 65 is a front, elevational view of the preferred arrangement of the progressive casings 20(*b*)', 20(*v*), 20(*v*)', and 20(*v*)". As shown, these casings 20(*b*)', 20(*v*), 20(*v*)', and 20(*v*)" are somewhat elongated vertically. Additionally, the seams 34 of these casings over the lower ribcage preferably have a wavy pattern or configuration. This configuration is preferred as the vulnerability or exposure (e.g., less muscle coverage) of the athlete's lower ribcage varies not only from the center 75 out to 77 as in FIG. 64 but also vertically downwardly, particularly from the chest area 67 past the lower ribcage toward the athlete's waist.

We claim:

1. A padding combination having a relatively hard, outer shell with an inner surface, said padding combination further including at least first, second, and third padded members, each padded member having an outer casing of substantially inelastic material containing resilient, discrete beads of substantially elastic material, means for mounting said first and second padded members adjacent spaced-apart sections of the inner surface of said shell and means for mounting said third padded member adjacent said inner surface of said shell between said spaced-apart sections of said inner surface and between said first and second padded members, said first, second, and third padded members each having a thickness wherein said first and second padded members are thicker than said third padded member to thereby form a bridge structure under the inner surface of said shell, said padding combination being positionable adjacent a user's body with said first and second padded members substantially abutting the user's body and said third padded member spaced from the user's body wherein the force of a blow to the shell is at least initially transferred to the user's body at said first and second padded members.

2. The padding combination of claim 1 wherein said first and second casings are overfilled with said beads wherein substantially all of said beads in said first and second casings are in compression.

3. The padding combination of claim 2 wherein said third casing is overfilled with said beads.

4. The padding combination of claim 1 wherein at least one of said first and second padded members includes a stack of two, substantially inelastic casings containing resilient, discrete beads of substantially elastic material.

5. The padding combination of claim 4 wherein one of said casings in said stack is thicker than the other.

6. The padding combination of claim 4 wherein the casings of said stack are attached to each other.

7. The padding combination of claim 4 wherein the stacked casings are substantially the same size.

8. The padding combination of claim 1 further including a fourth padded member with a thickness less than said first and second padded members and means for positioning said fourth padded member adjacent said inner surface of said shell between said third padded member and one of said first and second padded members.

9. The padding combination of claim 8 wherein said third and fourth padded members are of different thicknesses.

10. The padding combination of claim 9 wherein said fourth padded member is thinner than the third padded member and is positioned closer to the center of the inner surface of the shell between the first and second padded members than the third padded member.

11. The padding combination of claim 1 wherein said hard, outer shell has at least two, distinct portions and means for supporting said portions between said first and second padded members for movement relative to each other.

12. The padding combination of claim 11 wherein said third padded member is mounted adjacent one of said two, distinct portions of said shell and said padding combination further includes at least a fourth padded member and means for mounting said fourth padded member adjacent the other of said two, distinct portions between said first and second padded members, said fourth padding member having a thickness less than the thickness of at least one of said first and second padded members.

13. The padding combination of claim 12 wherein the third padded member is positioned adjacent the first padded member toward the center of said inner surface and said fourth padded member is positioned adjacent the second padded member toward the center of the inner surface wherein said fourth pad is thinner than said second padded member.

* * * * *